US009414673B2

(12) United States Patent
Behar et al.

(10) Patent No.: US 9,414,673 B2
(45) Date of Patent: Aug. 16, 2016

(54) SUSPENSION CHAIR, MODULAR FURNITURE ARRANGEMENT AND MODULAR FURNITURE KIT

(71) Applicant: HERMAN MILLER, INC., Zeeland, MI (US)

(72) Inventors: Yves Behar, San Francisco, CA (US); Qin Li, South San Francisco, CA (US); Naoya Edahiro, San Francisco, CA (US); Noah Murphy-Reinhertz, San Francisco, CA (US); Diana Chang, San Francisco, CA (US); Erik Kreider, San Francisco, CA (US); Casey Doran Lewis, Highland, UT (US); Andrew J. Kurrasch, Saugatuck, MI (US); Elindo G. Castro, Jr., Wyoming, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 14/213,425

(22) Filed: Mar. 14, 2014

(65) Prior Publication Data

US 2014/0312661 A1 Oct. 23, 2014

Related U.S. Application Data

(60) Provisional application No. 61/791,874, filed on Mar. 15, 2013.

(51) Int. Cl.
*A47C 15/00* (2006.01)
*A47B 83/02* (2006.01)
(Continued)

(52) U.S. Cl.
CPC ..... *A47B 83/02* (2013.01); *A47B 83/045* (2013.01); *A47C 7/40* (2013.01); *A47C 7/54* (2013.01)

(58) Field of Classification Search
CPC ..... A47C 7/30; A47C 7/28; A47C 1/124; A47C 13/005; A47C 7/282; A47C 7/44
USPC ..... 297/248, 299, 353, 452.52, 452.53, 297/452.54, 452.56, 286, 296
See application file for complete search history.

(56) References Cited

U.S. PATENT DOCUMENTS 1,649,013 A * 11/1927 Bell ..... 297/299
1,769,294 A * 7/1930 Johnson et al. ..... 297/354.11
(Continued)

FOREIGN PATENT DOCUMENTS

GB 2179245 A * 3/1987 ..... A47C 7/00
JP 61226341 A * 10/1986 ..... B60N 1/02

OTHER PUBLICATIONS

International Search Report issued in related PCT Application No. PCT/US2014/028029, mailed Oct. 10, 2014, 11 pgs.

*Primary Examiner* — Laurie K Cranmer
(74) *Attorney, Agent, or Firm* — Michael Best & Friedrich LLP

(57) ABSTRACT

A suspension chair includes a first and second back support portion having first and second suspension elements extending in first and second substantially perpendicular directions respectively. The first and second suspension elements are tensioned so as to provide first and second normal biasing forces to the first and second body support portions. In one embodiment, the chair includes a fixed support defining an upper portion and a pivotable side support. A fabric layer covers at least a portion of the fixed support and a front surface of the side support. Various furniture arrangements and modular furniture kits incorporating one or more chairs, desks and/or tables are provided.

19 Claims, 27 Drawing Sheets

(51) Int. Cl.

| | |
|---|---|
| ***A47C 7/40*** | (2006.01) |
| ***A47C 7/54*** | (2006.01) |
| ***A47B 83/04*** | (2006.01) |

(56) References Cited

U.S. PATENT DOCUMENTS

| | | | | | |
|---|---|---|---|---|---|
| 3,049,377 | A | * | 8/1962 | Asaro et al. | 297/452.52 |
| 3,190,636 | A | * | 6/1965 | Ward et al. | 267/107 |
| 3,195,955 | A | * | 7/1965 | Richardson et al. | 297/452.52 |
| 3,231,904 | A | | 2/1966 | Shulkin | |
| 3,645,550 | A | * | 2/1972 | Biehl | 297/452.63 |
| 3,995,893 | A | * | 12/1976 | De La Taille et al. | 297/452.53 |
| 4,869,554 | A | * | 9/1989 | Abu-Isa et al. | 297/452.56 |
| 5,064,244 | A | * | 11/1991 | Sproule | 297/68 |
| D337,002 | S | * | 7/1993 | Gibson | D6/378 |
| 5,314,234 | A | | 5/1994 | England | |
| 5,326,153 | A | | 7/1994 | Muffi | |
| 5,360,255 | A | * | 11/1994 | Cook et al. | 297/232 |
| D411,376 | S | * | 6/1999 | Lewis et al. | D6/335 |
| 6,135,554 | A | | 10/2000 | Tsun et al. | |
| D446,950 | S | * | 8/2001 | Leon et al. | D6/335 |
| 6,499,807 | B1 | * | 12/2002 | Kaneda et al. | 297/452.52 |
| 6,626,497 | B2 | * | 9/2003 | Nagamitsu et al. | 297/452.15 |
| 6,923,505 | B2 | | 8/2005 | Siminovitch et al. | |
| 6,994,399 | B2 | * | 2/2006 | Van-Thournout et al. | 297/284.4 |
| 7,276,018 | B2 | | 10/2007 | Studdard | |
| 7,334,845 | B2 | * | 2/2008 | Peterson et al. | 297/452.63 |
| 7,373,677 | B2 | | 5/2008 | Barthelt | |
| 8,764,114 | B1 | * | 7/2014 | Frank et al. | 297/440.16 |
| 2003/0001420 | A1 | * | 1/2003 | Koepke | A47C 1/03255 297/440.15 |
| 2004/0095000 | A1 | * | 5/2004 | Durling | 297/188.2 |
| 2008/0211277 | A1 | * | 9/2008 | Goetz et al. | 297/230.14 |
| 2009/0091174 | A1 | | 4/2009 | Diffrient | |
| 2009/0127905 | A1 | | 5/2009 | Schmitz et al. | |

* cited by examiner

SUSPENSION CHAIR, MODULAR FURNITURE ARRANGEMENT AND MODULAR FURNITURE KIT

This application claims the benefit of U.S. Provisional Application No. 61/791,874, filed Mar. 15, 2013, the entire disclosure of which is hereby incorporated herein by reference.

TECHNICAL FIELD

The present application is directed to a suspension chair and, separately, to modular furniture arrangements incorporating a chair, together with methods for the arrangement and assembly thereof.

BACKGROUND

Various types of suspension seating arrangements are well known. Typically, such arrangements provide a flexible suspension member that it tensioned between two or more support members. The suspension member may directly support the body of the user, or may be covered by a fabric layer. Due to the linear nature of the tension vectors applied in such suspension members, such arrangements are generally not suitable for seating systems providing orthogonal back supports, and do not provide any transitional support between such supports.

In addition, the support members typically provide a "hard" point at the side edge of the seating arrangement. As such, any configuration wherein such seating arrangements are positioned adjacent one another provides intermittent hard points that limit the comfort and use of the configuration.

In another aspect, office "side" chairs are typically configured with a pair of armrests, or no armrests. In either case, the office chair, if associated with a worksurface, such as a desk, must either be moved by the user to gain proximity to the worksurface, wherein the user may be trapped by the armrests, or in the absence of such arms fails to provide any support for the user's arms when situated by a worksurface. Moreover, the upper surfaces of armrests, when so configured, typically do not mate with or transition to the worksurface, thereby leading to pinch points, uneven surfaces and/or other obstacles.

Besides not being suitable for use with a worksurface, such office chairs may also not be suitable for modular use, for example to provide various community seating configurations.

SUMMARY

Briefly stated, in one aspect, one embodiment of a suspension chair includes a first back support portion having a first linear support surface extending along a first direction and a second back support portion having a second linear support surface extending along a second direction, wherein the second direction is substantially perpendicular to the first direction. A third back support portion includes an outwardly facing concave surface transitioning between the first and second back support portions. The first and second back support portions include first and second suspension elements extending in the first and second directions respectively. The first and second suspension elements are tensioned so as to provide first and second normal biasing forces to the first and second body support portions.

In another aspect, one embodiment of a suspension chair includes a base, a fixed support supported by the base and defining an upper portion of a back, and a side support supported by the base and pivotable about a horizontal axis. The side support has a front surface and an upper portion moveable toward and away from the upper portion of the fixed support. A fabric layer covers at least a portion of the fixed support and a front surface of the side support.

In another aspect, one embodiment of a furniture arrangement includes a first chair having a first side surface lying in a first substantially vertical plane. The first side surface is defined in part by a first fixed support defining an upper portion of a first back and a first side support pivotable about a horizontal axis. The first side support has an upper portion moveable toward and away from the upper portion of the first fixed support. A second chair has a second side surface lying in a second substantially vertical plane, wherein the second side surface is defined in part by a second fixed support defining an upper portion of a second back and a second side support pivotable about the horizontal axis. The second side support has an upper portion moveable toward and away from the upper portion of the second fixed support. The first and second chairs are positioned such that the first and second sides are adjacent.

In yet another aspect, one embodiment of a furniture arrangement includes a worksurface having a side edge and opposite front and rear edges. The worksurface is vertically spaced so as to define leg space beneath each of the front and rear edges. A chair is positioned adjacent the rear edge and includes a backrest defined by first and second back support portions extending in first and second directions, wherein the first and second back support portions are substantially perpendicular. The first back support portion has an end positioned adjacent the rear edge such that the second back support portion is spaced from the rear edge and defines an ingress/egress opening between the second back support portion and the rear edge. The first and second back support portions and the rear edge define a U-shaped occupancy space in plan view.

In yet another aspect, a modular furniture kit includes at least four chairs each having a backrest defined by first and second back support portions extending in first and second directions, wherein said first and second directions are substantially perpendicular, wherein a rear surface of each of the first and second back supports are substantially linear in the first and second directions. An upper surface of each of the first and second back supports includes a planar armrest surface. The chairs are capable of being arranged in each of at least a first and second configuration. The first configuration includes a pair of the chairs arranged with the rear surfaces lying adjacent such that the planar armrests define a T-shape in plan view. The second configuration includes four of the chairs arranged with the rear surfaces lying adjacent such that the planar armrests define a X-shape in plan view.

The various aspects and embodiments provide significant advantages over other chair, furniture arrangements and modular furniture kits. For example and without limitation, in one embodiment, the chair is configured with a unique suspension back that provides a biasing force in orthogonal directions. In addition, in one embodiment, a chair may be arranged relative to a worksurface to provide a supportive and integrated interface that avoids the need to move the chair. In addition, the various chairs may be easily reconfigured to provide different seating configurations suitable for the desired environment.

The present embodiments of the invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "top," "upper," "bottom" and "lower" are intended to indicate directions when viewing a chair or desk when positioned for use. It should be understood that the term "plurality," as used herein, means two or more. The term "coupled" means connected to or engaged with, whether directly or indirectly, for example with an intervening member, and does not require the engagement to be fixed or permanent, although it may be fixed or permanent. The term "transverse" means extending across an axis, including without limitation substantially perpendicular to an axis. It should be understood that the use of numerical terms "first," "second," "third," etc., as used herein does not refer to any particular sequence or order of components; for example "first" and "second" portions may refer to any sequence of such portions, and is not limited to the first and second portions of a particular configuration unless otherwise specified.

Chair

Figure 2:
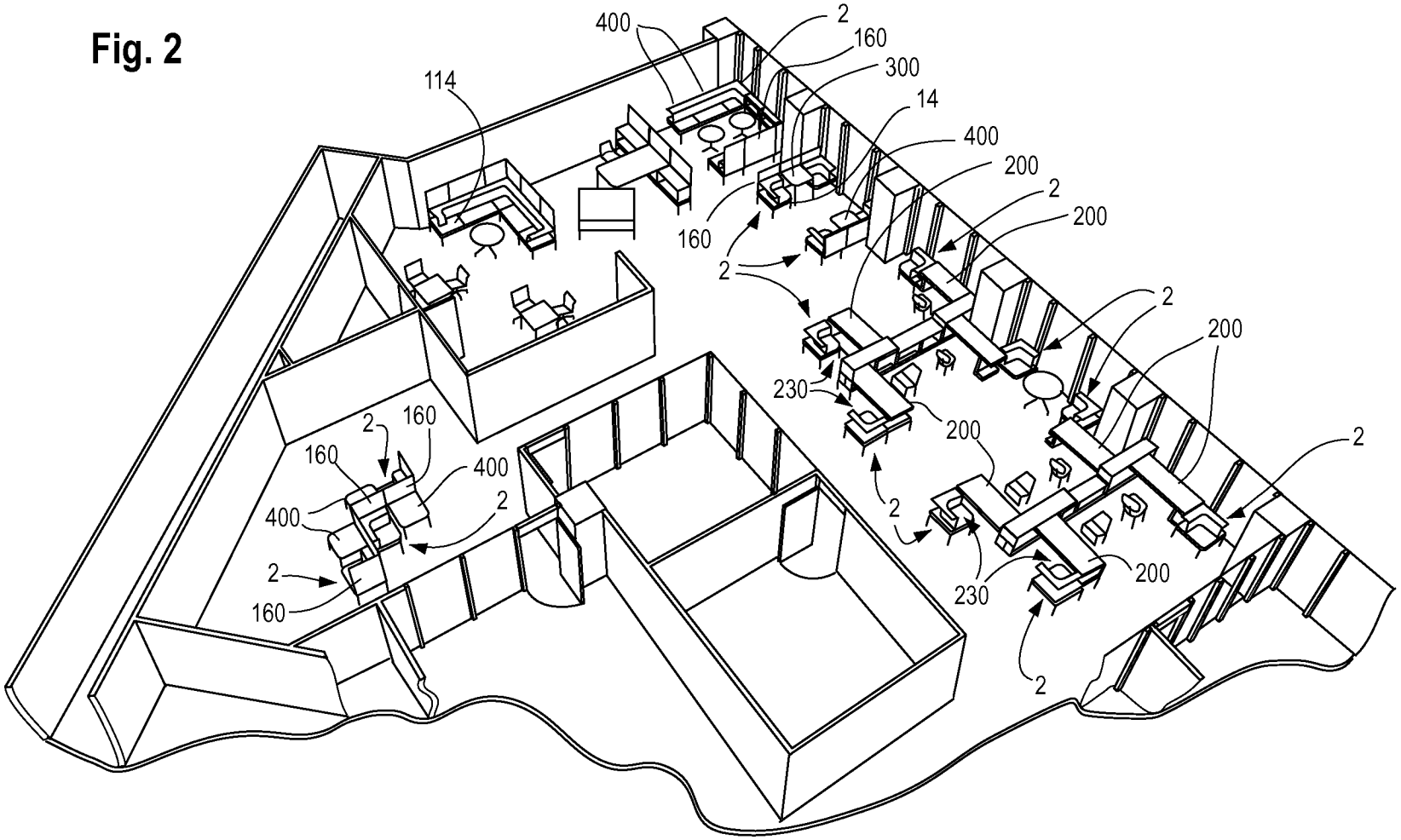
FIG. 2 is a perspective view of another embodiment of an office environment.

Referring to FIGS. 11-30, a suspension chair 2 has a seat portion 4 and a backrest portion 6. The chair 2 includes a frame 8 having a base 10 and a fixed support 12 extending upwardly from the base, with the fixed support 12 defining part of the backrest portion and the base defining part of the seat portion. The term "fixed" means not moveable, such that the support 12 is not moveable relative to the base 10, but rather remains stationary. The base 10 and seat portion 4 have a substantially square footprint in plan view, with the front corner 14, 114 thereof being either curved or squared off. For example, as shown in FIG. 2, the front corner 14, 114 may be curved in arrangements where a user may need to slide their legs from one side 16 of the chair to the other side 18, for example when situating themselves with their legs under a desk 200. The front corner may be squared off and form a right angle in plan view in situations where the chair is part of a modular arrangement with other seating surfaces being positioned adjacent the chair such that the arrangement provides a continuous, linear edge along the adjacent edges.

The fixed support 12 includes a pair of side members 22, 24 fixedly connected to the base and extending upwardly therefrom. The side members may be angled rearwardly relative to a vertical axis at an angle $\alpha$, or may be oriented within a vertical plane. The angle $\alpha$ of inclination is in range of 9-14 degrees. An intermediate or center support 26 may also be angled along a diagonal direction extending from a front to a rear corner of the base, or may be vertically oriented. An upper portion 28 is connected to the side members 22 and center support 26. The upper portion 28 is configured as a horizontal platform in one embodiment, with linear rear edges 30, 32 forming a right angle and linear front edges 34, 36 lying perpendicular to one another, with a curved transition portion 38 extending therebetween. The upper portion surface includes side edges 40, 42 lying perpendicular to one another, and connecting the rear and front edges 30, 34, 32, 36. The upper portion platform 28 defines an armrest and has a width War suitable for supporting an arm of a user, or otherwise providing a planar support surface. The platform 28 may be made of a fabricated steel frame. The platform is covered by a fabric layer, as further explained below, but may also include a cushion layer 33, such as foam, and/or an additional translucent spacer layer.

Figure 16B:
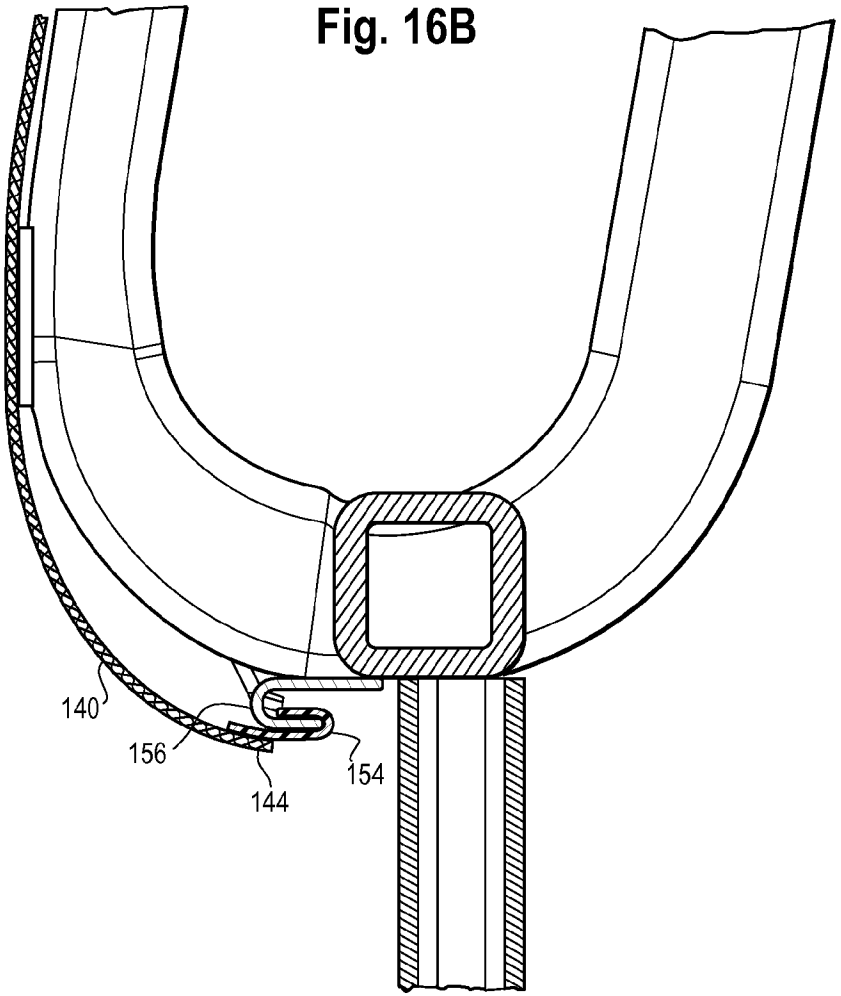
FIGS. 16A and B are cross-sectional views of a fabric attachment device including a J-hook.
Figure 16A:
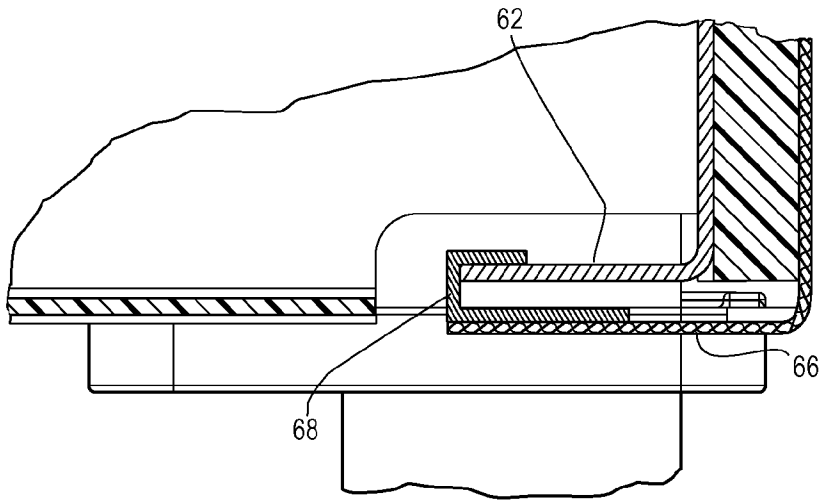
Figure 19:
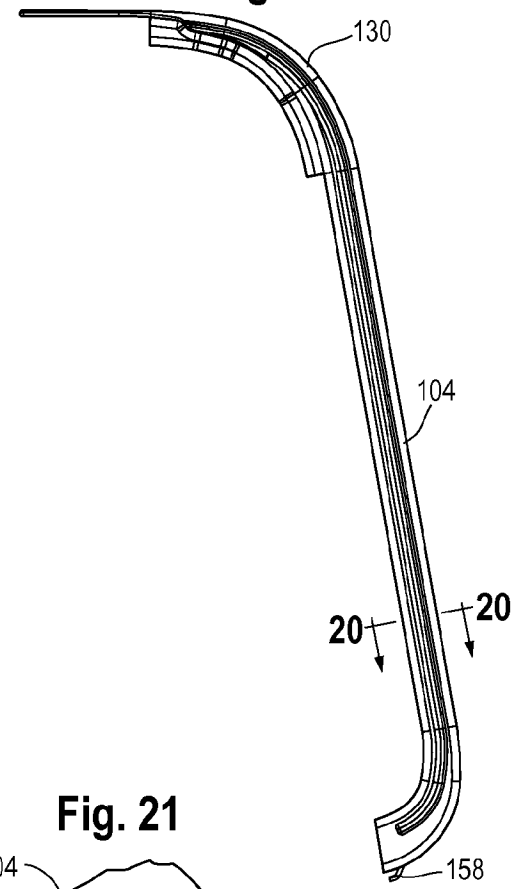
FIG. 19 is a side view of the side support shown in FIG. 17.
Figure 35:
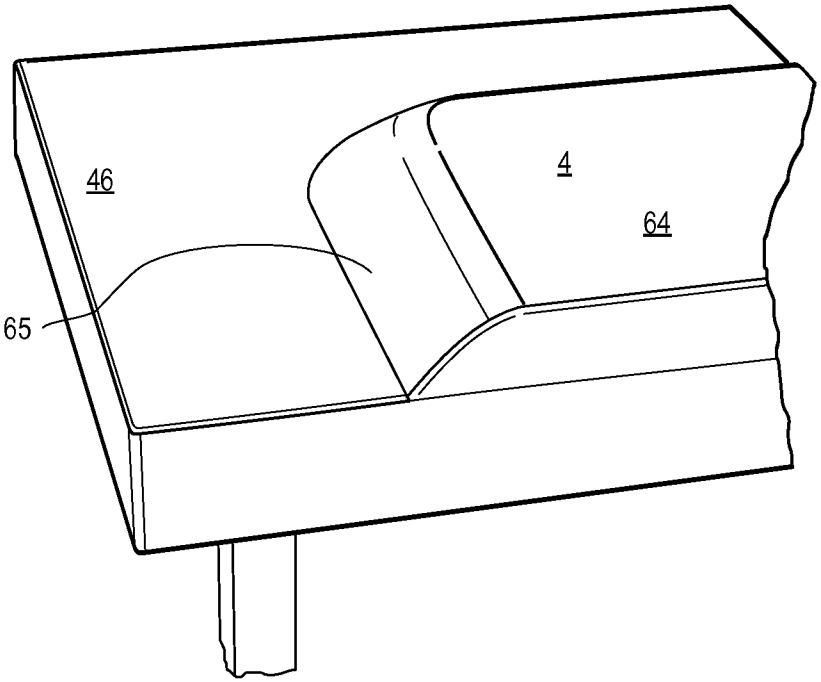
FIG. 35 is a partial perspective view of the seat, including a cushion.
Figure 37:
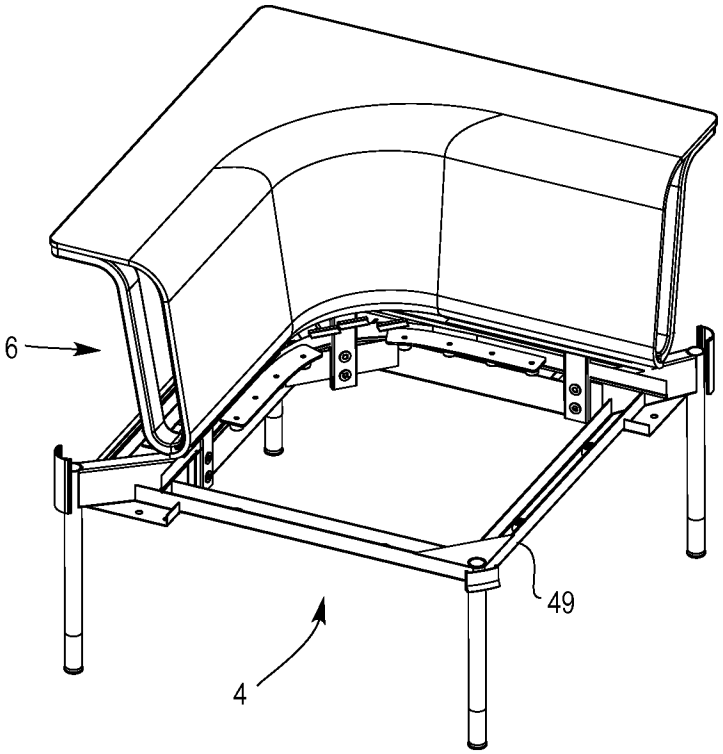
FIG. 37 shows the chair of FIG. 36 with the seat cushion removed.
Figure 36:
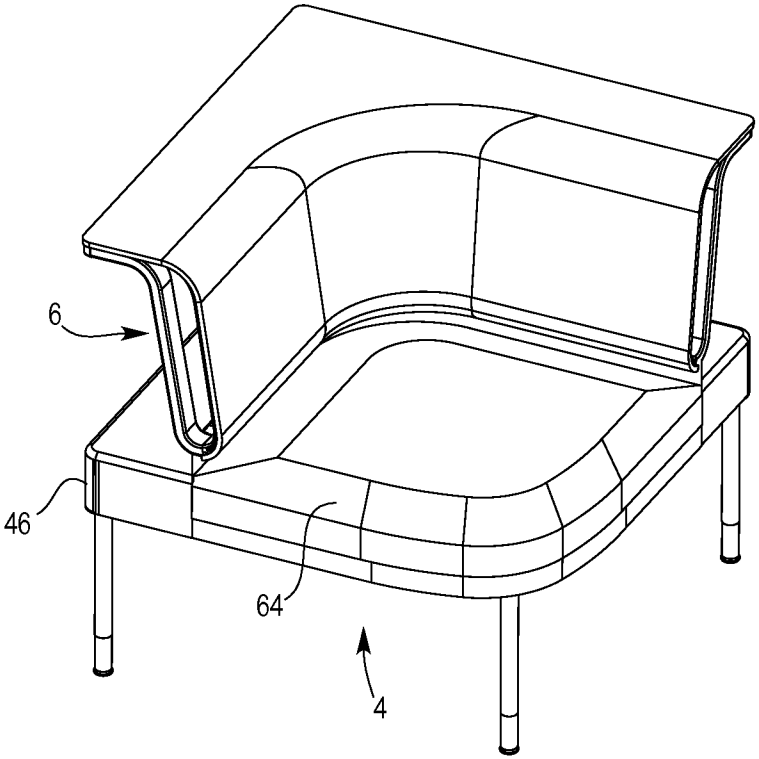
FIG. 36 shows an alternative embodiment of a chair with a seat cushion.

The base 10 defines a second platform 46, or shelf, vertically spaced from and directly underlying the upper portion, or armrest, with linear rear edges 48, 50 forming a right angle and directly underlying the rear edges 30, 32 of the upper portion in one embodiment. The platform, or perimeter block, may be made of expanded polypropylene foam (EPP) in one embodiment, or a sheetmetal frame, and supports the cushion and/or suspension, and connects to the frame. As shown in FIGS. 36, 37 and 49, the platform 46 includes a front perimeter portion 47 that may support the suspension member, or the cushion directly, for example with retainer straps 51. The platform is supported by a perimeter frame 49. In other embodiments, the rear edges may be offset from the upper edges, or may be curved or have other profiles. The base further defines the footprint of the seat portion 4, which may include a seat frame 52 defining an opening 54 in front of the second platform 46 and one or more flexible suspension members 56 put in tension across the opening of the frame. The suspension member, of the seat and backrest, may be formed from a plurality of elastomeric straps 58, as disclosed in U.S. Publication Nos. 2005/0279591, entitled "Load Bearing Surface," and U.S. Publication No. 2012/0237719, entitled "Load Bearing Support Surface," the entire disclosure of which is hereby incorporated herein by reference. The straps 58 include opposite end portions 60, 62 secured to the frame. The seat may further include foam or other cushion member 64 supported by the suspension member. Alternatively, the cushion may be supported by a frame without a suspension member. The cushion material has a rear beveled portion as shown in FIGS. 35 and 36, such that the cushion mates with the bottom of the backrest support surface, which transitions rearwardly. In one embodiment, the cushion may be made of a soft urethane foam. A fabric layer 66 may extend over the cushion and be secured to an edge defined by the frame 52 with an engagement member 68, for example and without limitation by J-hooks as shown in FIG. 16A. The base is supported by a plurality of legs 70, shown as four, at the four corners thereof.

Figure 23:
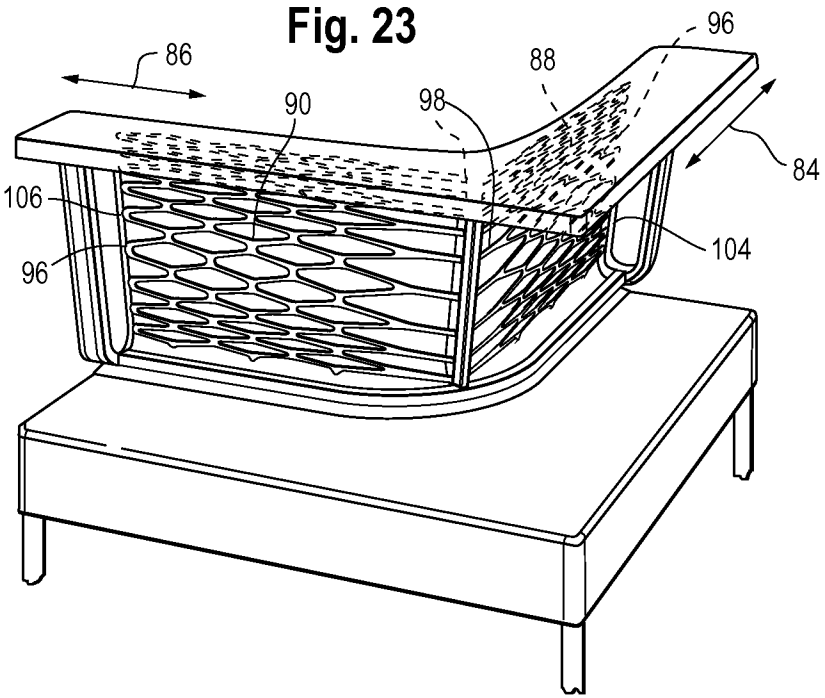
FIG. 23 is a rear perspective view of a chair showing first and second suspension elements connected to the frame.
Figure 24:
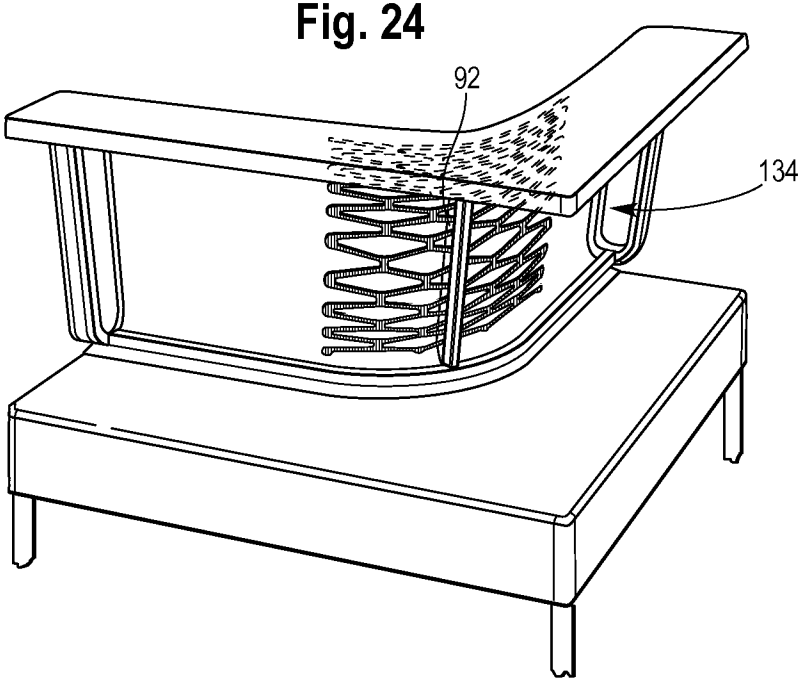
FIG. 24 is a rear perspective view of a chair showing a third suspension element with the first and second suspension elements being omitted for the purpose of clarity.
Figure 26:
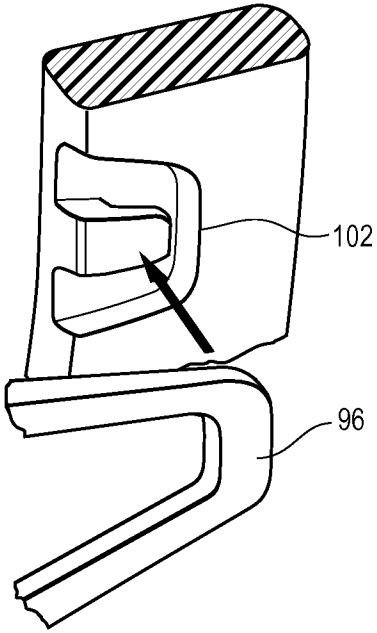
FIG. 26 is an enlarged partial view of the suspension element and side support shown in FIG. 25.
Figure 25:
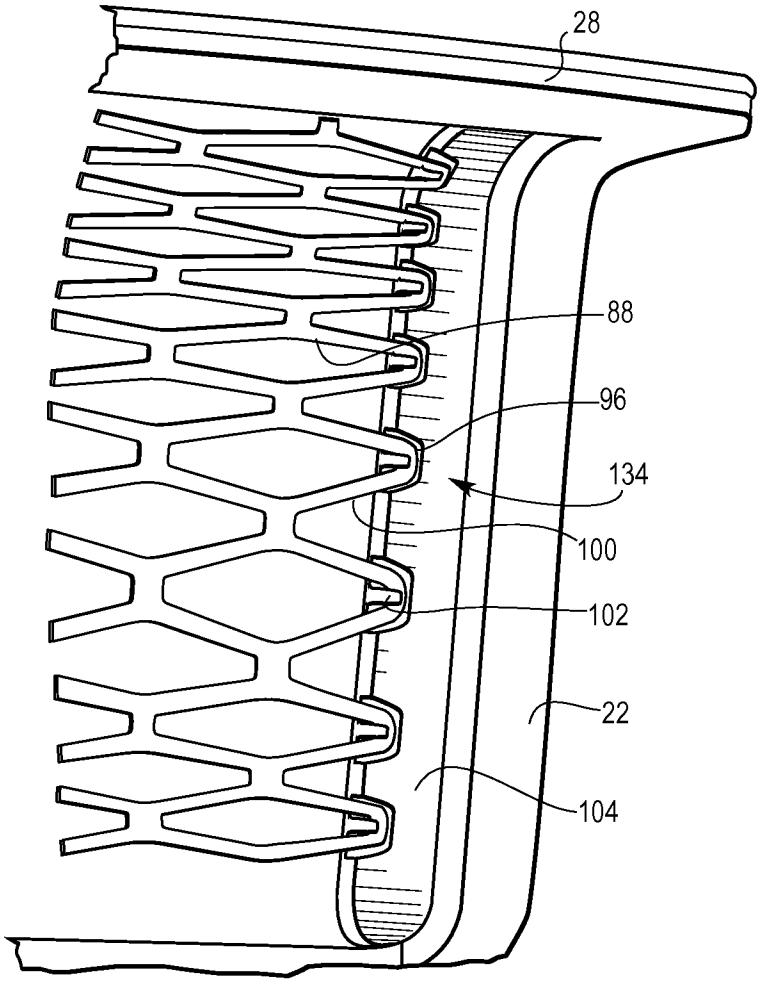
FIG. 25 is a partial view of one embodiment of a suspension element connected to a side support.
Figure 27:
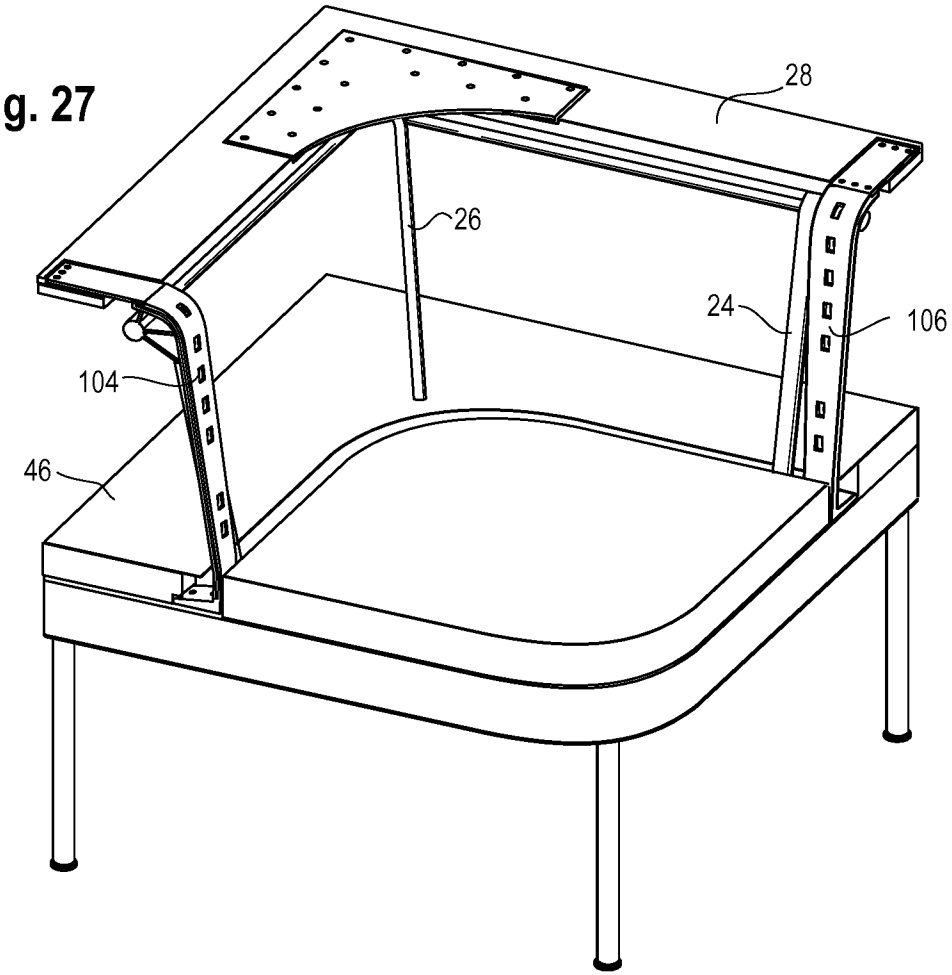
FIG. 27 is a front perspective view of one embodiment a chair frame.
Figure 29:
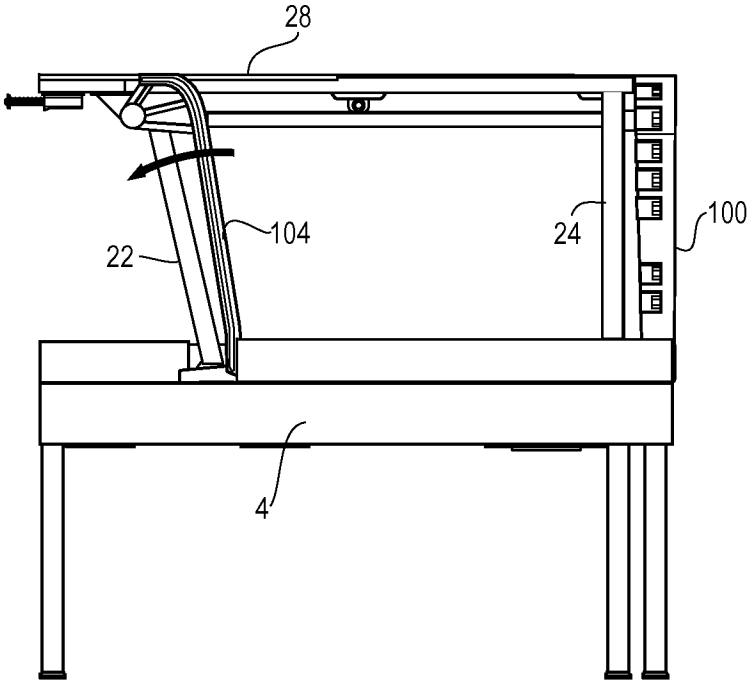
FIG. 29 is a side view of the chair frame shown in FIG. 27.
Figure 28:
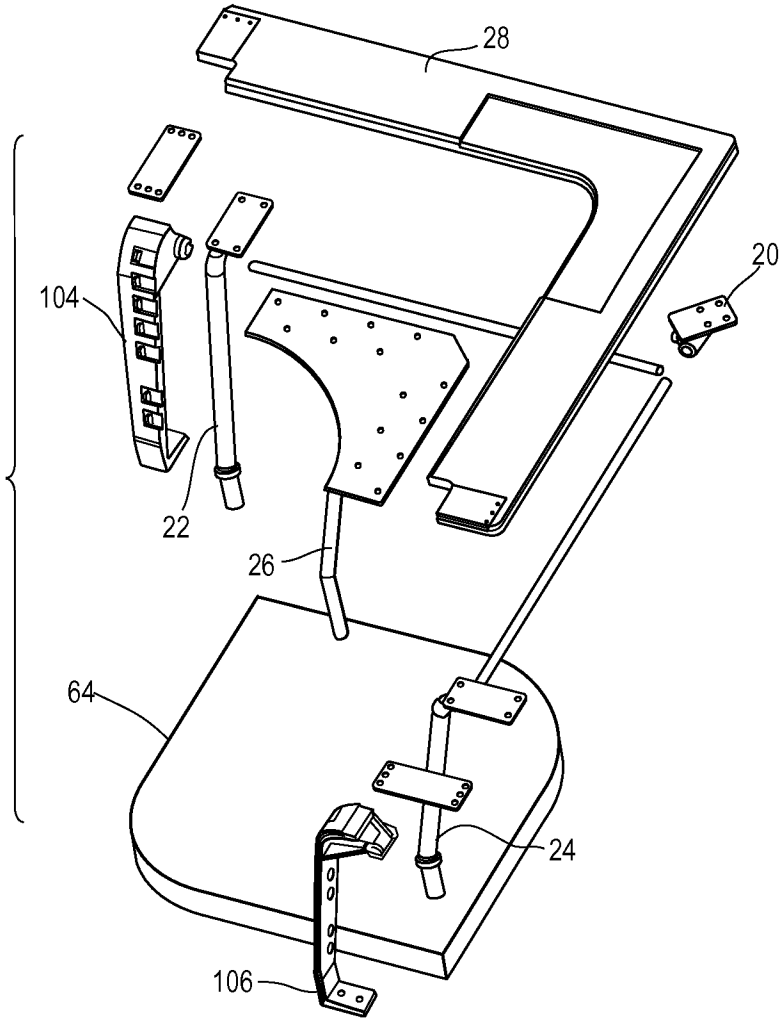
FIG. 28 is a side perspective view of the chair frame shown in FIG. 27.
Figure 30:
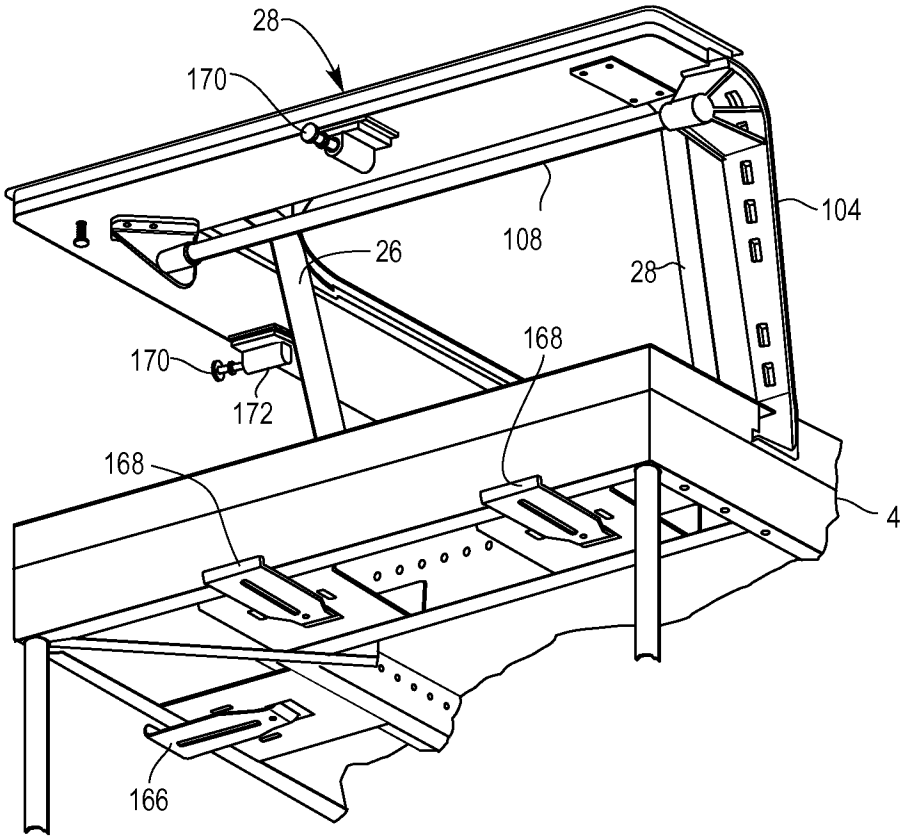
FIG. 30 is a bottom perspective view of the chair shown in FIG. 27.
Figure 32:
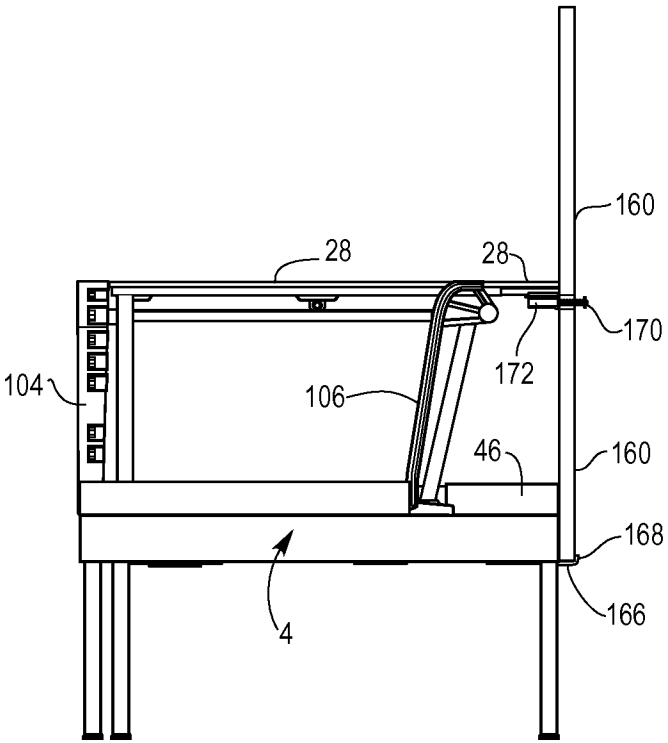
FIG. 32 is a partial side view of the chair shown in FIG. 32 with the screen secured thereto.
Figure 31:
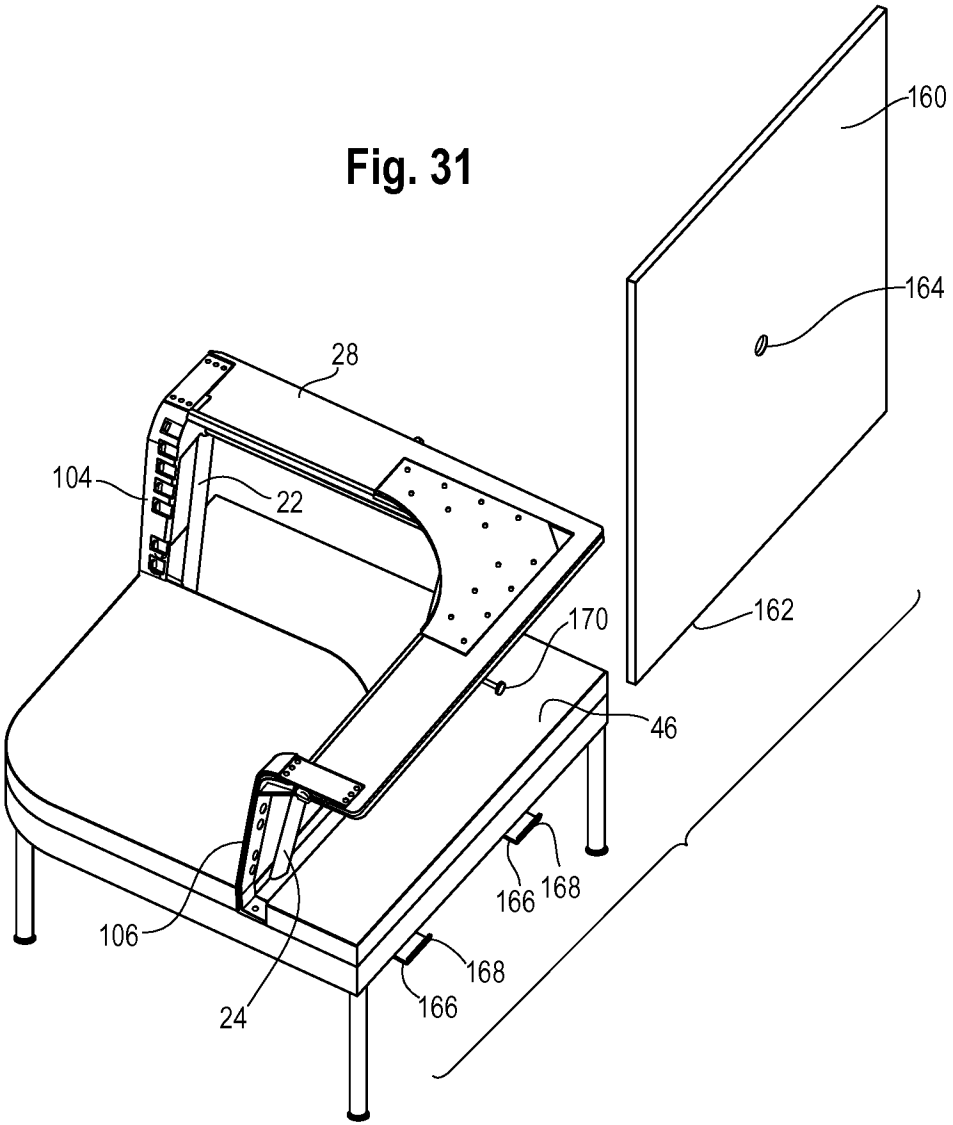
FIG. 31 is a partial, exploded perspective view of a chair and a screen.
Figure 38:
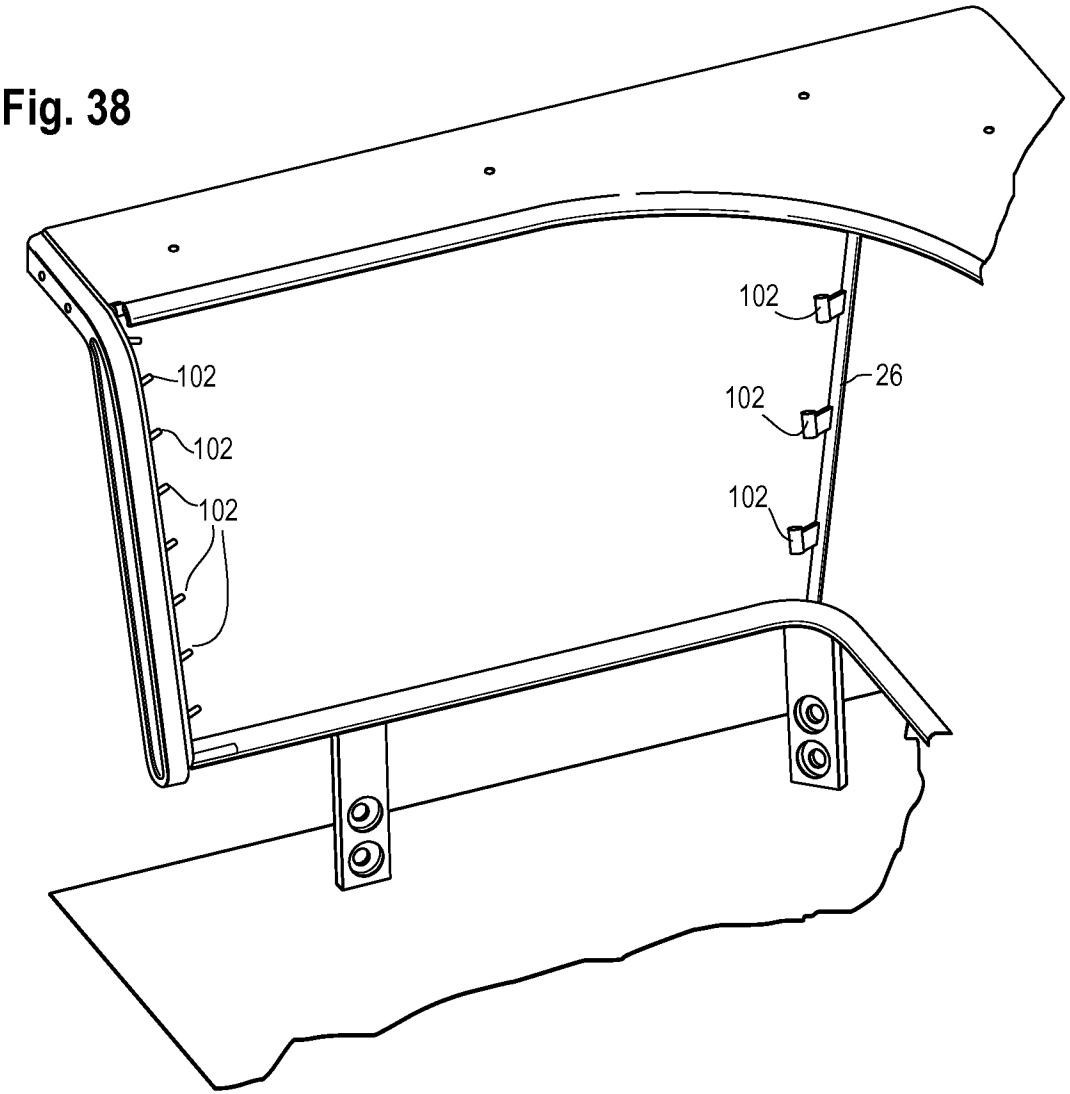
FIG. 38 shows an embodiment of a backrest frame.
Figure 39:
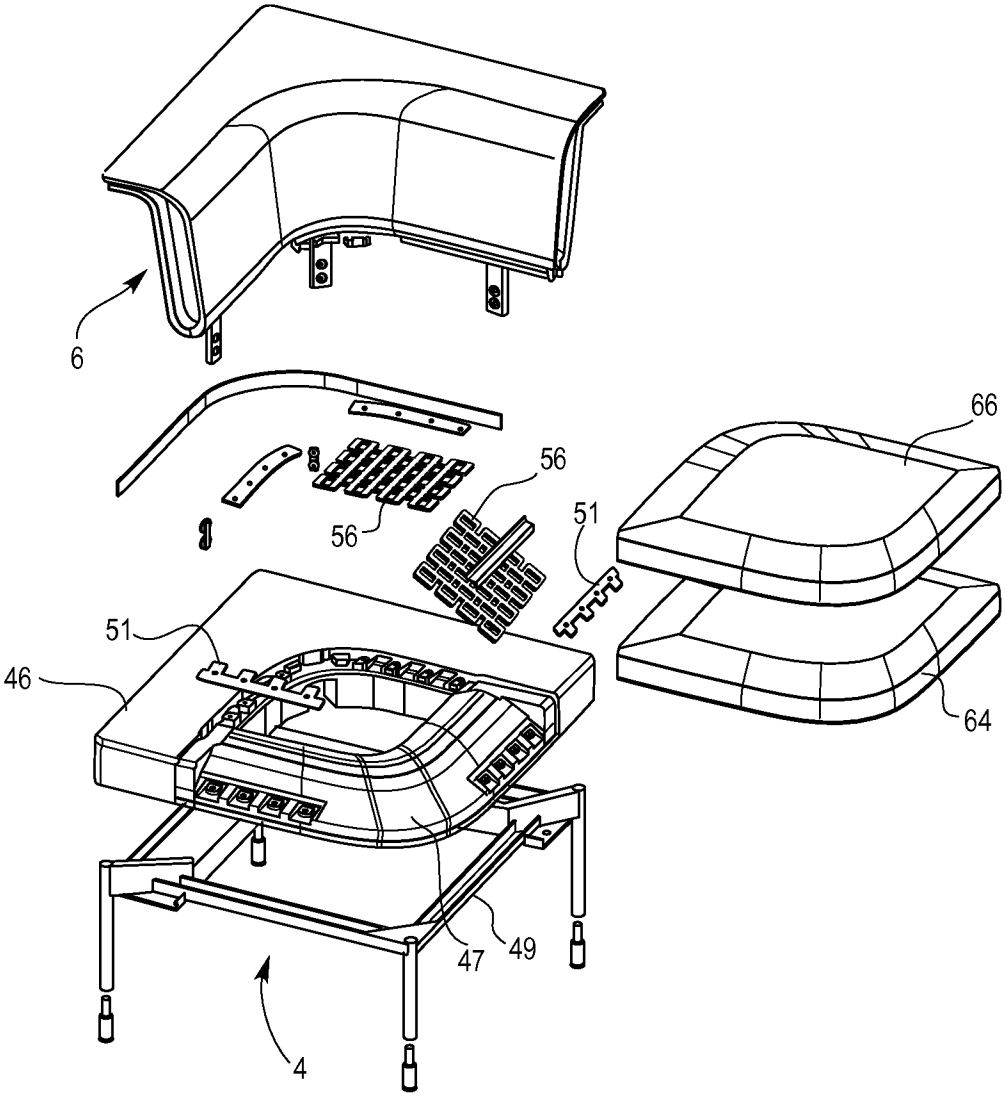
FIG. 39 is an exploded view of one embodiment of a chair.

A first back support portion 72 has a first linear support surface 78 extending along a first direction 84. A second back support portion 74 has a second linear support surface 80 extending along a second direction 86, with the second direction 86 being substantially perpendicular to the first direction 84. A third back support portion 76 has an outwardly facing concave support surface 82 transitioning between the first and second back support portions. The first, second and third back support portions 72, 74, 76 extend between the seat 4 and the upper portion 28 of the fixed support. As shown in FIG. 23, the first and second back support portions 72, 74 include first and second suspension elements 88, 90 extending in the first and second directions 84, 86 respectively. The first and second suspension elements 88, 90 are tensioned so as to provide first and second normal biasing forces 92, 94 to the first and second body support portions 72, 74. In one embodiment, the first and second suspension elements are tensioned in the first and second directions 84, 86 respectively. In one embodiment, the suspension elements 88, 90 are configured as elastomeric nets, having a plurality of diamond shaped openings, with first and second end portions 96, 98. As shown in FIG. 25, loops 100 on the suspension elements 88, 90 are coupled to hooks 102 extending from side support elements 104, 106. The center support may also have hooks 102 to engage the suspension elements 88, 90 as shown in FIG. 38. The suspension elements may alternatively have hook portions that engage openings 35 formed in the side support elements 104, 106. In other embodiments, the suspension elements may be configured as straps, made for example of a thermoplastic polyester elastomer. Referring to FIG. 24, a third suspension element 92 is coupled to the first and second suspension elements 88, 90 and underlies the curved back support portion 76. The third suspension element applies tension forces to the first and second suspension elements when biased by a user.

The first and second side support elements 104, 106 are positioned adjacent to define a side edge 108, 110 of respective ones of the first and second body support portions, which are coplanar with and define sides 16 and 18 of the chair and side edges 40, 42 of the upper platform 28. In this regard, it should be understood that the suspension elements, including back and seat elements, in some Figures are shown in an exploded configuration without attachment, and they are therefore are not elongated due to a lack of tension being applied thereto. The side support elements 104, 106 support one end 96 or edge of the suspension elements as just discussed. Opposite ends 98 of the suspension elements are connected to the center support 26. Alternatively, two or more of the suspension elements 88, 90, 92 may be integrally formed, with opposite ends 96 thereof coupled to the side support elements 104, 106 and with a middle region wrapped around the center support 26, with tension vectors being applied in perpendicular directions 84, 86 between the center support 26 and the first and second side support elements 104, 106.

Figure 34:
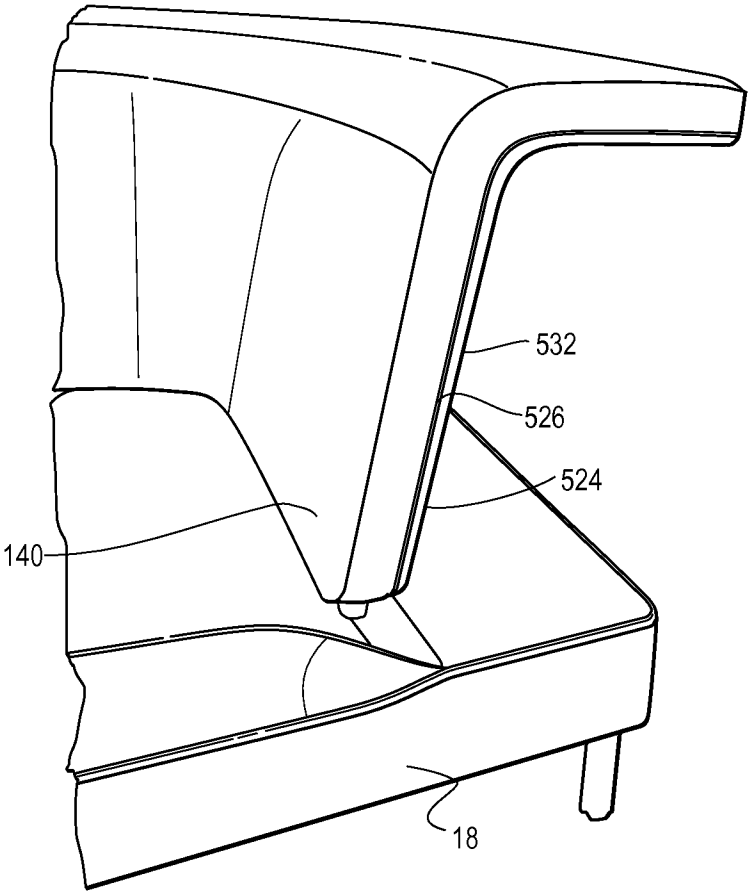
FIG. 34 is a partial side perspective view of an alternative embodiment of a chair.

Referring to FIG. 34, it should be understood in one embodiment that the first and second side support elements may be omitted altogether, with the suspension elements coupled to the side members 522, which are disposed adjacent the sides 16, 18 of the chair in this embodiment. The side members in this embodiments may have a different shape, for example approximating the combined shape of the side members and side support elements of the embodiment shown in FIG. 13. In addition, the rear surface 524 of the backrest, including the bottom of the shelf 28 may be covered with a fabric 526, with the overall thickness of the backrest, including the side members and front and rear fabric layers, having a thickness (e.g., 1.5 inches) and inclination similar to a wall 222 of an adjoining desk 200.

In one embodiment, the first and second side support elements 104, 106 are pivotable about first and second axes extending in the first and second directions 84, 86 respectively. The term pivotable refers to the support elements being directly pivotable about an axis, such as pin, or pivotable about a virtual axis, for example by way of the support elements bending or flexing, with the bottom end thereof being fixedly attached to the base. First and second brace members 108, 110 have a first end 124 connected to and bracing the first and second side support elements 104, 106 in the first and second directions 84, 86 against tension forces applied by the first and second suspension elements 88, 90. The brace members 108, 110 have opposite end portions 126 connected to the center support 26, and/or to the fixed upper portion 28. In one embodiment, the connection of the end portion allows for rotation of the brace member as the opposite end thereof moves with the side supports. For example the ends 126 of the brace members may be pivotally connected to the fixed upper portion with pivot pads 120. In one embodiment, the upper portion 130 of the side support elements 104, 106 are curved and define a curved transition or shoulder region between the linear support surfaces 72, 74 and the horizontal platform 28. The side support elements may include a curved flange 133 that mates with a brace member and is secured thereto with fasteners 135. The platform 28 may also have a front curved lip 132. The side members 22, 24 and the side support elements 104, 106 may be aligned, with a gap 134 formed therebetween, such that the side support elements 104, 106 may be pivoted (e.g., by bending) rearwardly toward the side supports 22, 24. The brace members 108, 110 have end portions with a corresponding curved portion 124 to mate with the upper portion of the side support elements, with the brace members being secured to the side supports with a plurality of fasteners. It should be understood that the members may be joined by welding, tabs, or other known and suitable connection devices. The back portion includes a bottom frame member 136, and three straps or stanchions, which are connected to the base frame 52.

Figure 15A:
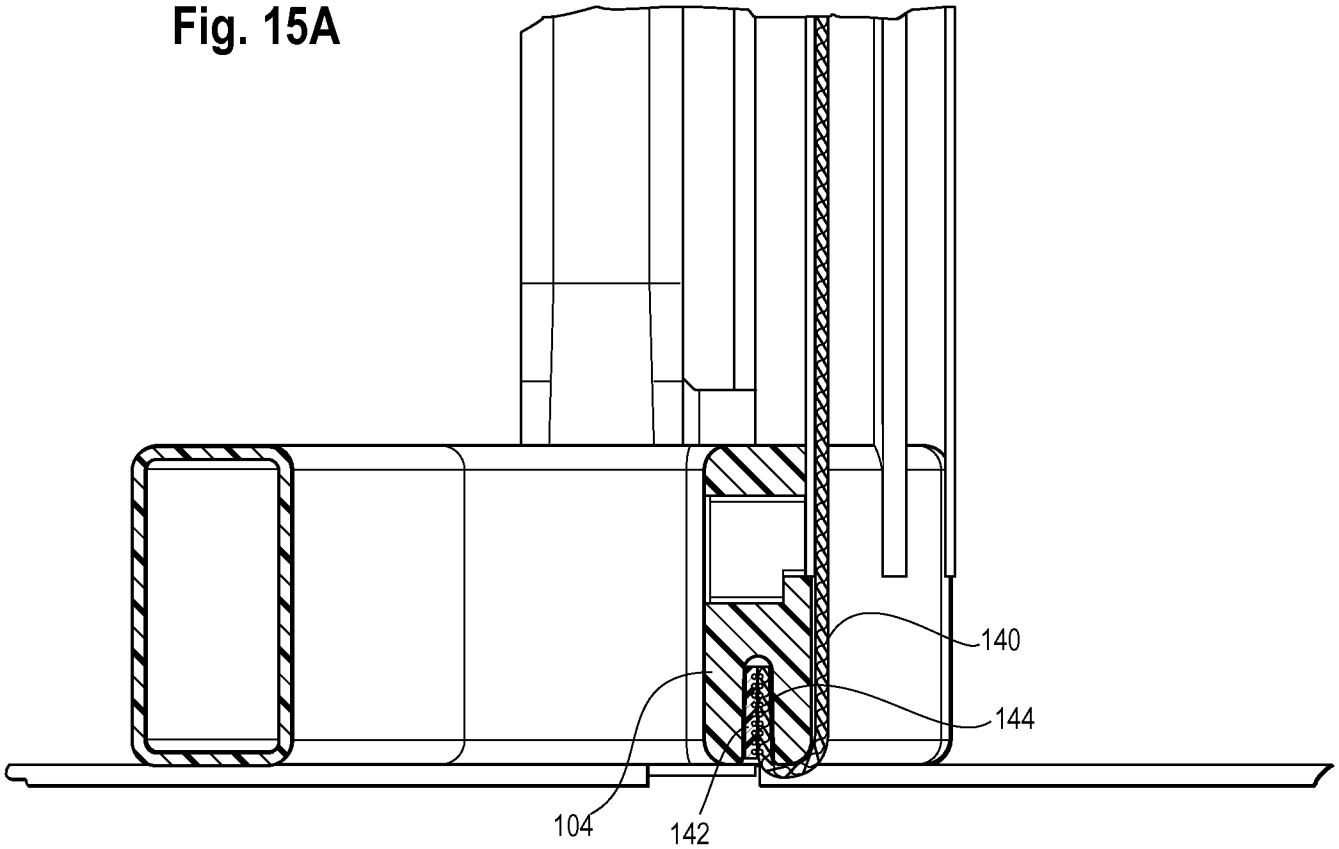
FIGS. 15A and B are cross-sectional views of a fabric attachment device including a spline.
Figure 15B:
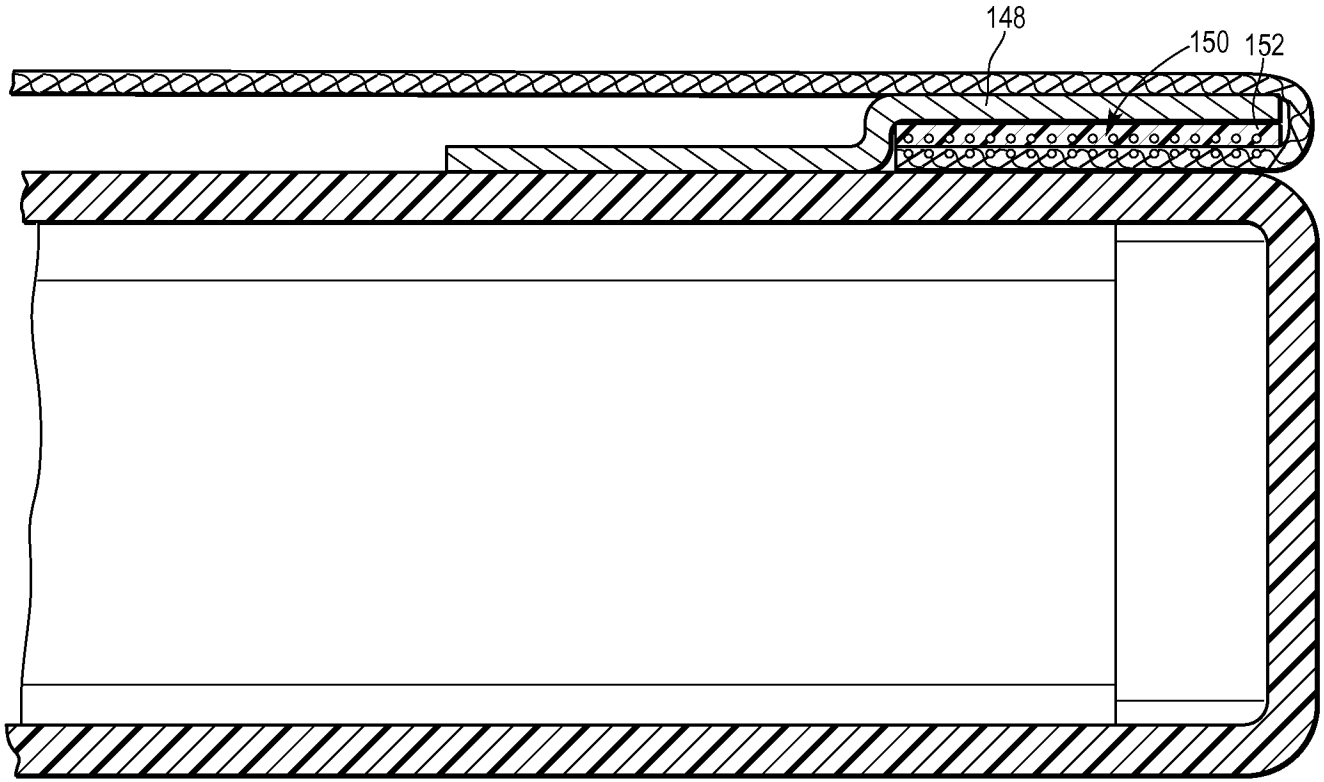
Figure 21:
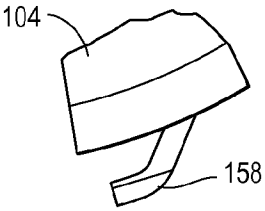
FIG. 21 is an enlarged view of a fabric attachment member taken along line 21 of FIG. 19.
Figure 18:
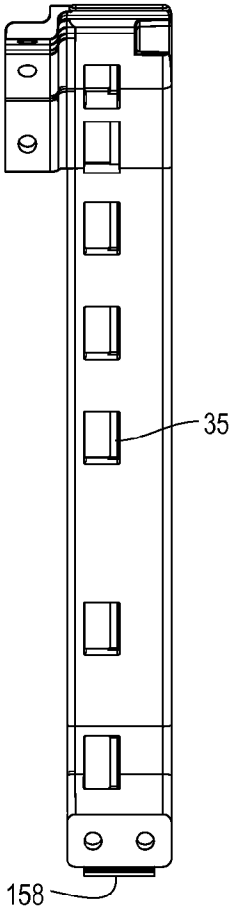
FIG. 18 is a front view of the side support shown in FIG. 17.
Figure 20:
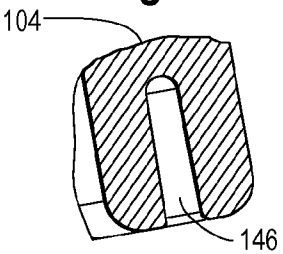
FIG. 20 is a cross-sectional view of the side support taken along line 20-20 of FIG. 19.
Figure 17:
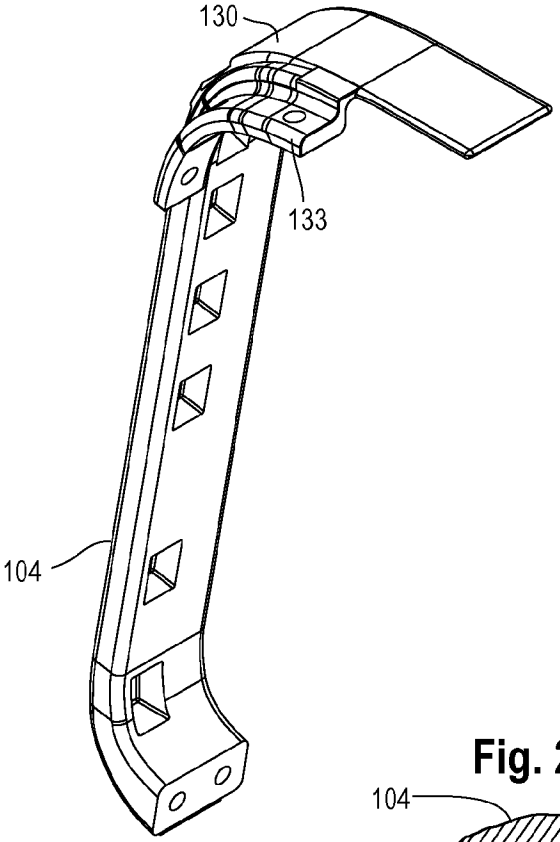
FIG. 17 is a perspective view of left side support.
Figure 22:
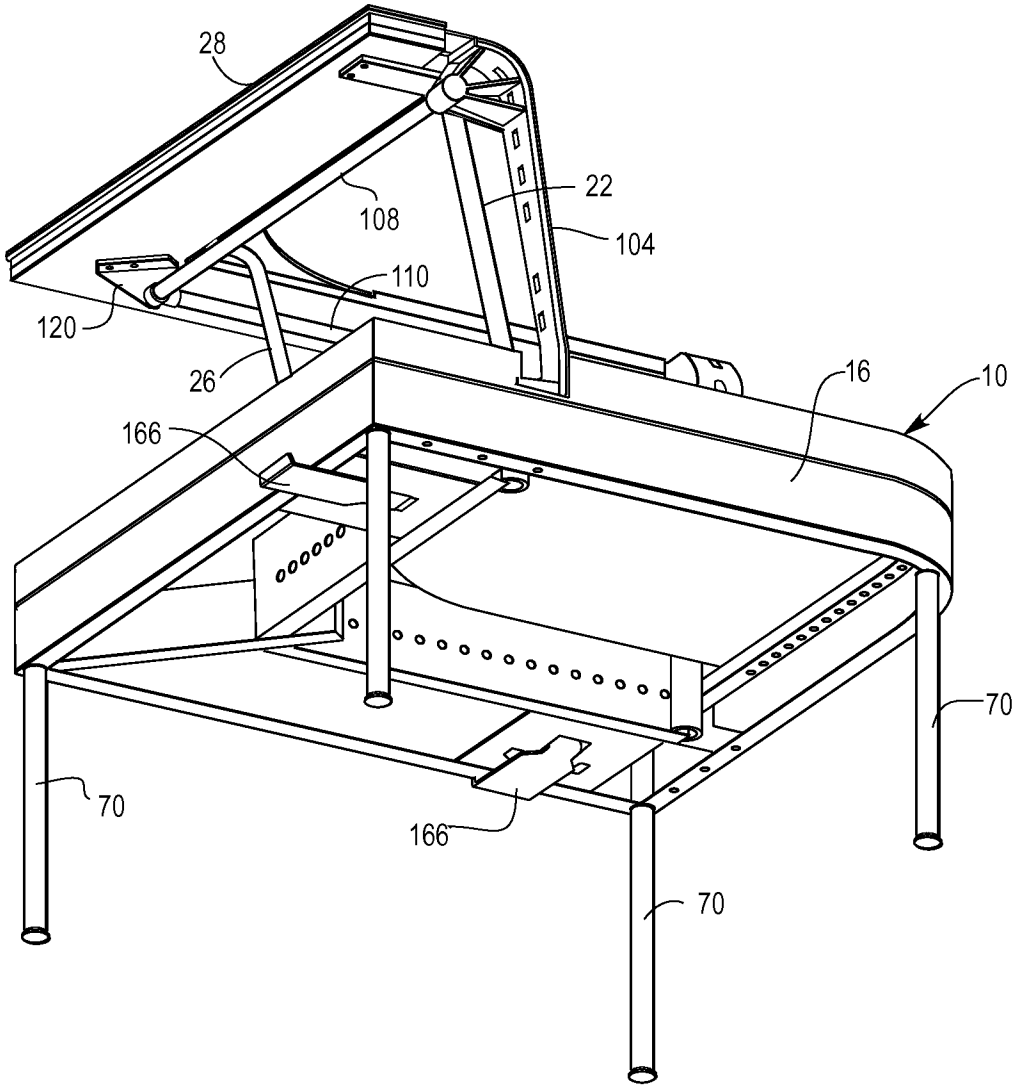
FIG. 22 is a perspective view of another embodiment of a chair frame.

A fabric layer 140, such as a knit fabric, covers and is supported by the first and second suspension elements 88, 90 and also covers the fixed support platform 28 so as to provide a uniform and continuous appearance to the back support. In various embodiments, the fabric layer 140 may be in direct contact with said first and second suspension elements, or may have a cushion, such as foam or clear spacer material, interposed therebetween. As shown in FIG. 15A, the fabric 140 overlies and wraps around the side support elements 104, 106 and has an edge portion 144 disposed in a groove 146 facing outwardly from a side surface of the side support element 104, 106. A spline 142 is attached to the fabric edge 144 and is inserted into the groove to securely hold the fabric. Referring to FIG. 15B, a bracket 148 is secured along a rear edge 30, 32 of the platform 28, and defines a groove 150. A spline 152 attached to the fabric edge portion 144 is inserted into the groove 150 to securely hold the fabric along the rear edge 30, 32. Referring to FIG. 16*b*, a bottom edge 144 of the fabric includes an engagement member 154, such as a J-hook, that engages a catch portion 156 extending from the frame. In this way, the fabric is secured along all edges 144 thereof. The bottom of the side support elements 104, 106 may also include a hook or catch portion 158, as shown in FIG. 21, that engages the engagement member 154, such as a J-hook, secured to the fabric.

In operation, a user may be seated in the chair 1 and lean against the first and second back support portions 72, 74, with the suspension elements 88, 90 biasing the user in a direction normal thereto. The side support elements 104, 106 flex or bend, i.e., pivot about a virtual axis, such that the upper portion 130 of the side support moves toward and away from the fixed support 28. For example, in one embodiment, the upper portion moves about 1 inch, although in various embodiments the upper portion may move between 0.25 inches and 2.00 inches.

Figure 3:
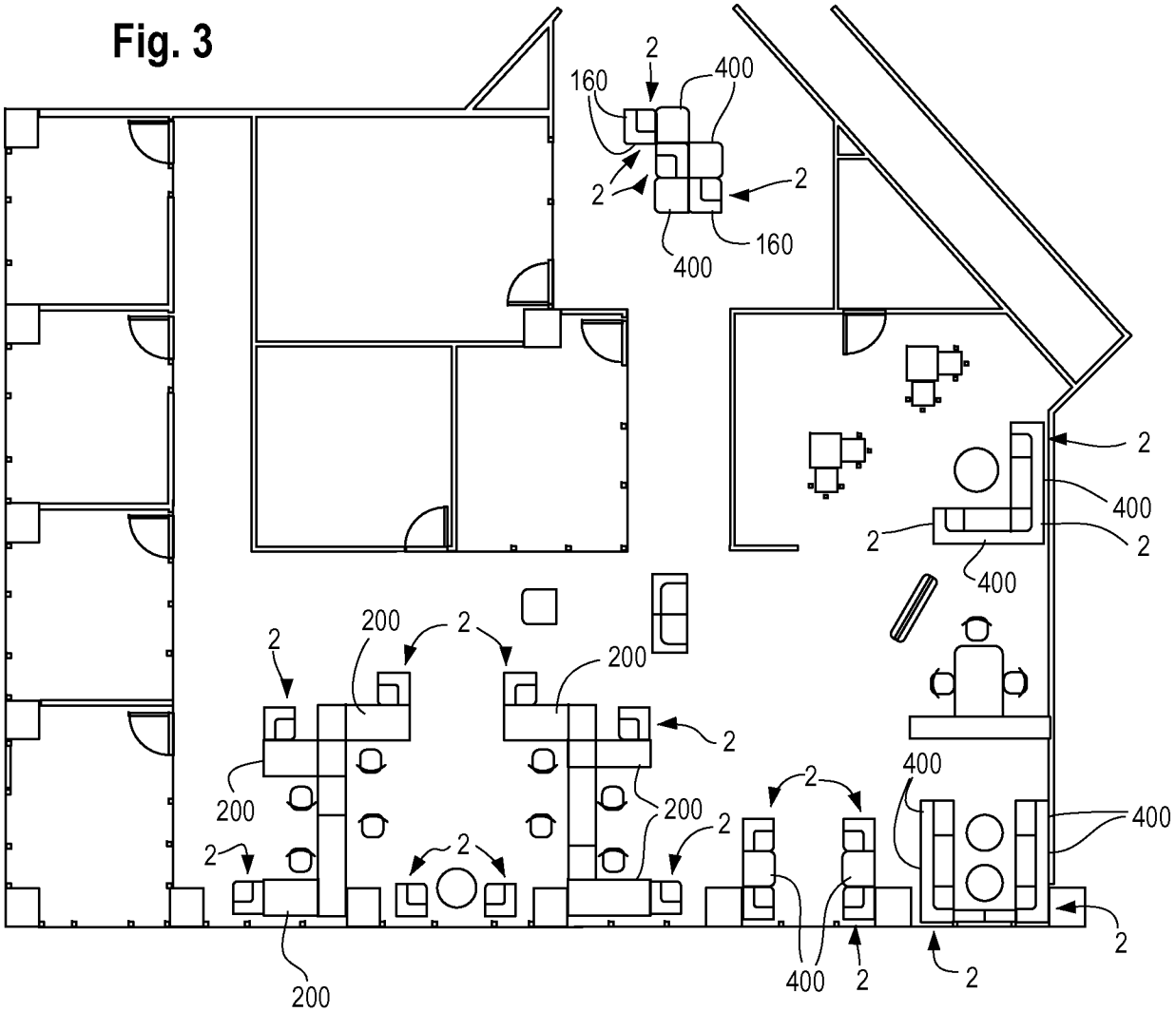
FIG. 3 is a plan view of the office environment shown in FIG. 2.

In various embodiments, a chair, or bench, may be made with a linear back, each side of which has a flexible side support element 104, 106. When two chairs are arranged side by side, the adjacent flexible side support elements 104, 106 give way and avoid applying a hard point to the user. This may be important in the situation where a pair of modular chairs are arranged side by side as shown in FIG. 3, or have a bench unit interposed therebetween, as further explained below.

Referring to FIGS. 2, 3, 31 and 32, a screen 160 may be secured to one or both of the rear sides of the chair. The screen has a bottom edge 162 supported by a pair of brackets 166 secured to the frame of the chair. The brackets have a lip 168 that wraps around and engages a rear surface of the screen. A pin 170 is inserted through an opening 164 in the middle of the screen and is releasably coupled to a bracket 172 secured to the platform 28, for example, with a push pin detent mechanism. The pin 170 may actuated and removed such that the screen 160 may be lifted off of the brackets. A pair of screens may be mounted to the rear sides of the chair.

Desks and Tables

Figure 4:
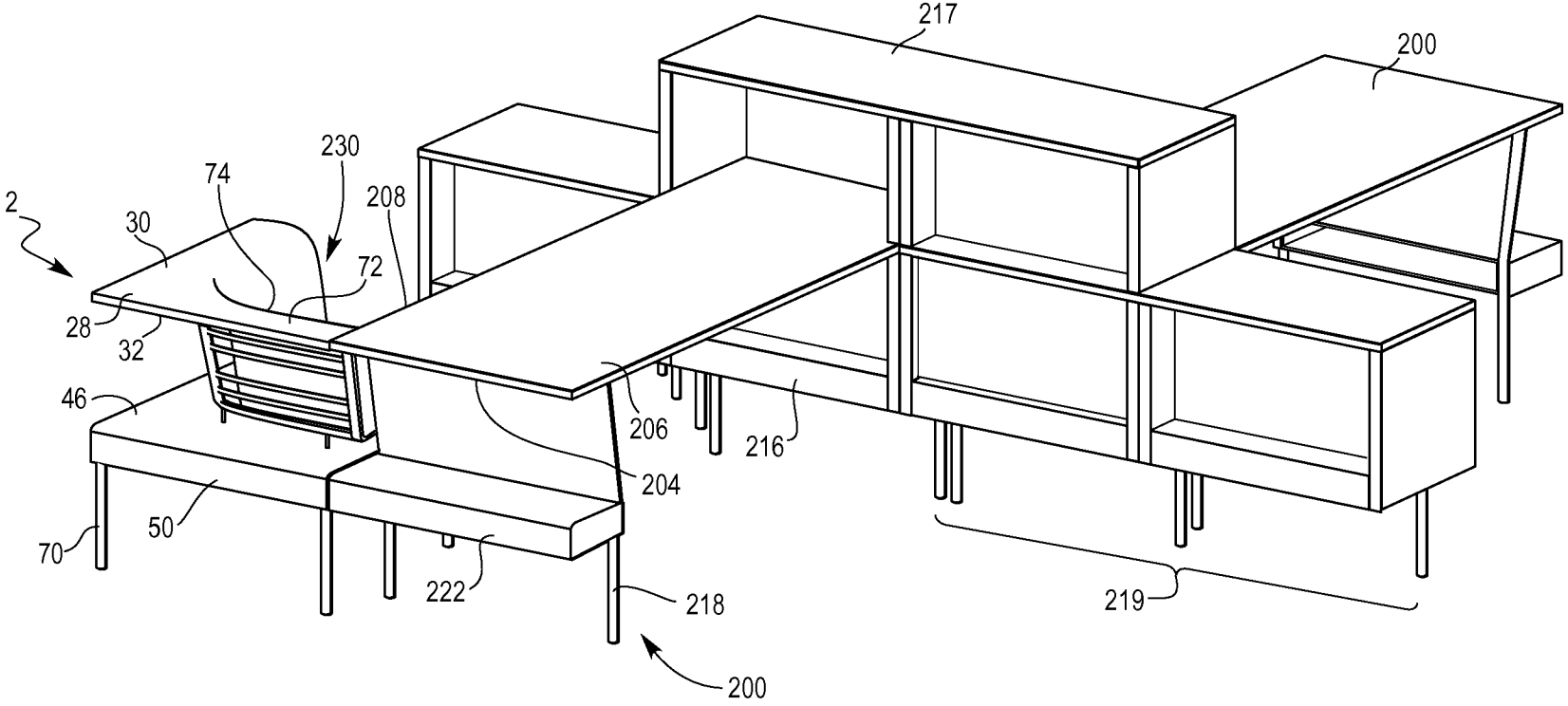
FIG. 4 is a partial perspective view of a desk and chair arrangement.
Figure 5:
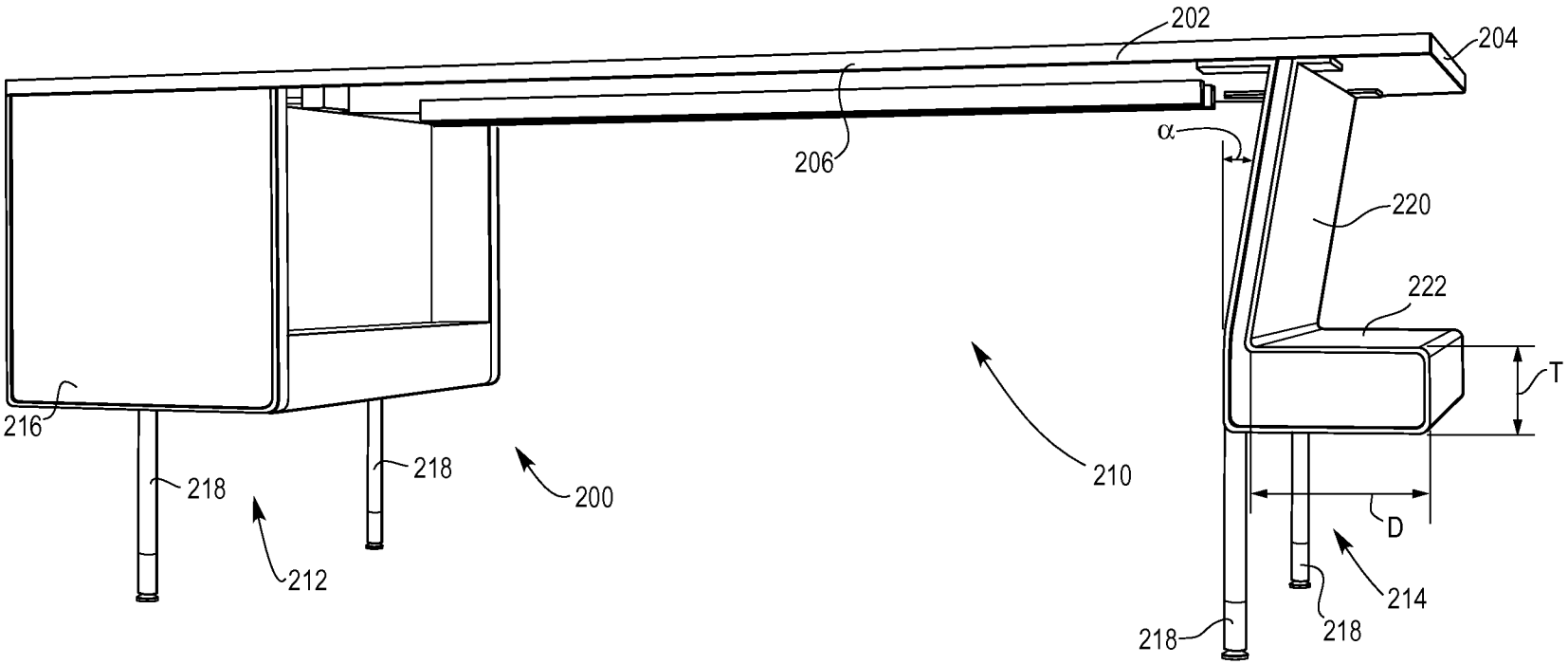
FIG. 5 is a right side perspective view of one embodiment of a desk.
Figure 6:
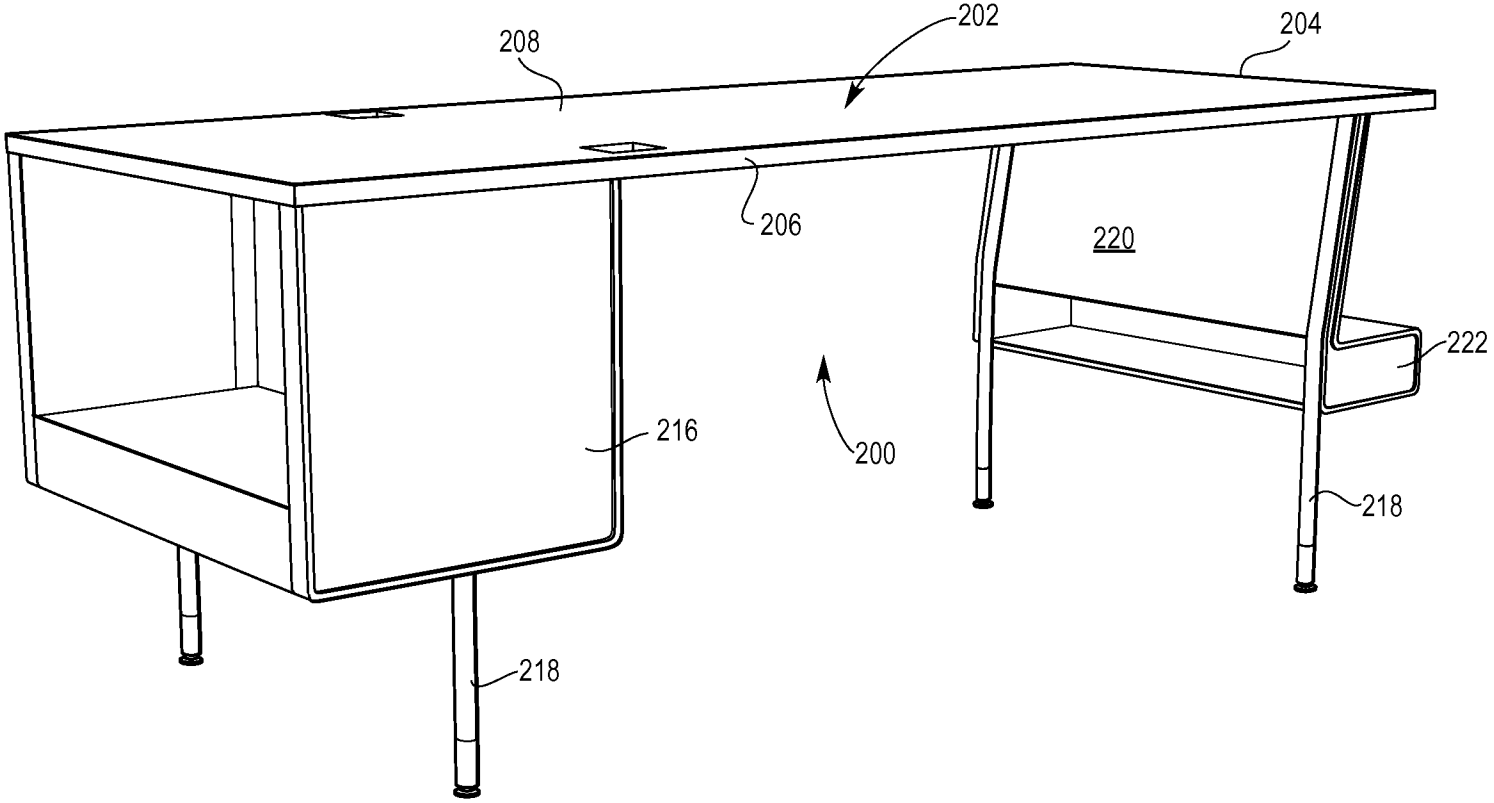
FIG. 6 is a left side perspective view of the desk shown in FIG. 5.

Referring to FIGS. 1, 2 and 4-10, a desk 200 is shown as including a worksurface 202 having a side edge 204 and opposite front and rear edges 206, 208. The worksurface 200 is vertically spaced so as to define leg space 210 beneath each of the front and rear edges. The worksurface is supported on opposite ends by first and second support structures 212, 214. The first support structure includes a storage cabinet 216 supporting the worksurface and a pair of legs 218 supporting the storage cabinet in a vertically spaced relationship to the floor. The storage 216 may be part of a central spine assembly 219, with one or more worksurfaces 202 being supported thereby and extending orthogonal to the spine as shown in FIG. 4. Additional storage 217 may be situated above the worksurface 202. The second support 214 includes a wall 220 that is oriented at an angle $\alpha$ relative to a vertical plane, with the orientation lying substantially co-planar to the inclination of the seat back supports 72, 74. The second support further includes a first shelf 222 underlying the worksurface and extending outwardly from the wall 220. The shelf 222 has an edge 224 underlying and aligned with the edge 204 of the worksurface. In one embodiment, the shelf 222 has a thickness T and depth D substantially the same as the thickness of the platform 46 of the chair. In other embodiments, the shelves 222, 46 may have different thicknesses, heights and depths, and may have edges that are linear, curved, or combinations thereof.

In operation, a chair 2 is positioned adjacent the rear edge 208 of the worksurface as shown in FIG. 4. The chair includes a back support element 74 having a side 18 positioned adjacent the rear edge 208 such that the back support portion 72 is spaced from the rear edge 208 in a substantially parallel relationship and defines an ingress and egress opening 230 between the back support portion 72 and the rear edge 208. The side edge 204 of the worksurface 202 and the rear edge 32 of the platform 28 or armrest are substantially aligned and coplanar in one embodiment. The upper surface of the shelf 46 defined by the base of the chair lies substantially coplanar with the upper surface of the shelf 222 of the worksurface. In one embodiment, the shelves 46, 222 have substantially the same depth and thickness. The outer surface of the wall 220 is substantially co-planar with the rear surface of the back support portion 74. The upper surface of the armrest platform 28 is substantially coplanar with the upper surface 200 of the worksurface.

Figure 1:
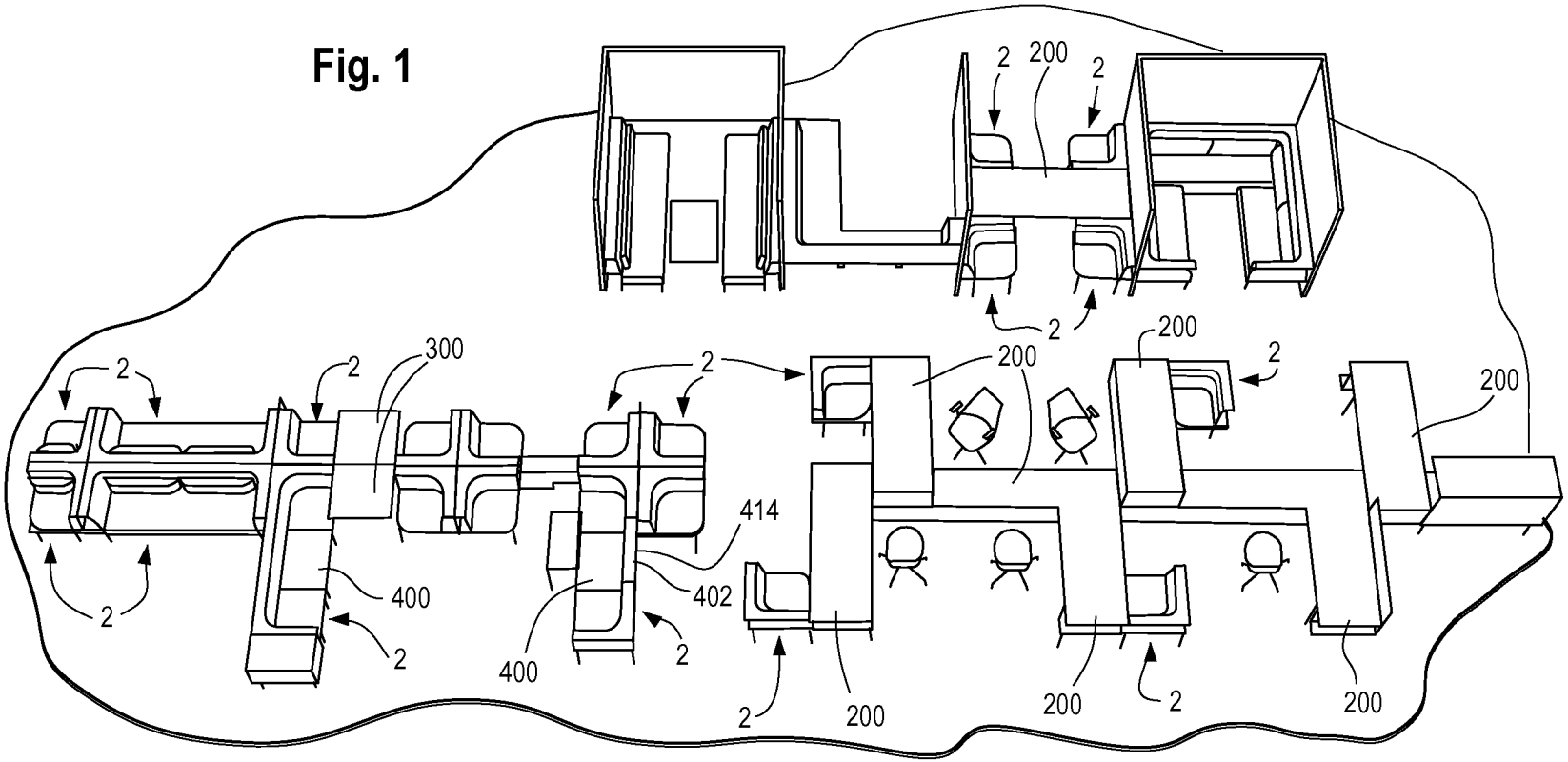
FIG. 1 is a perspective view of one embodiment of an office environment.
Figure 7:
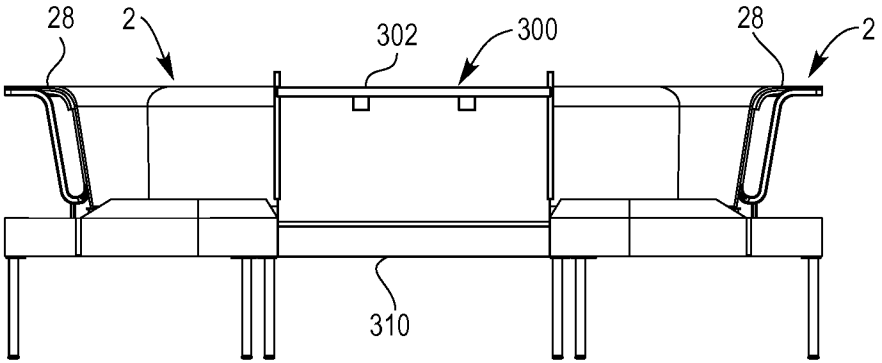
FIG. 7 is a front view of a furniture configuration having four chairs and a worksurface.
Figure 8:
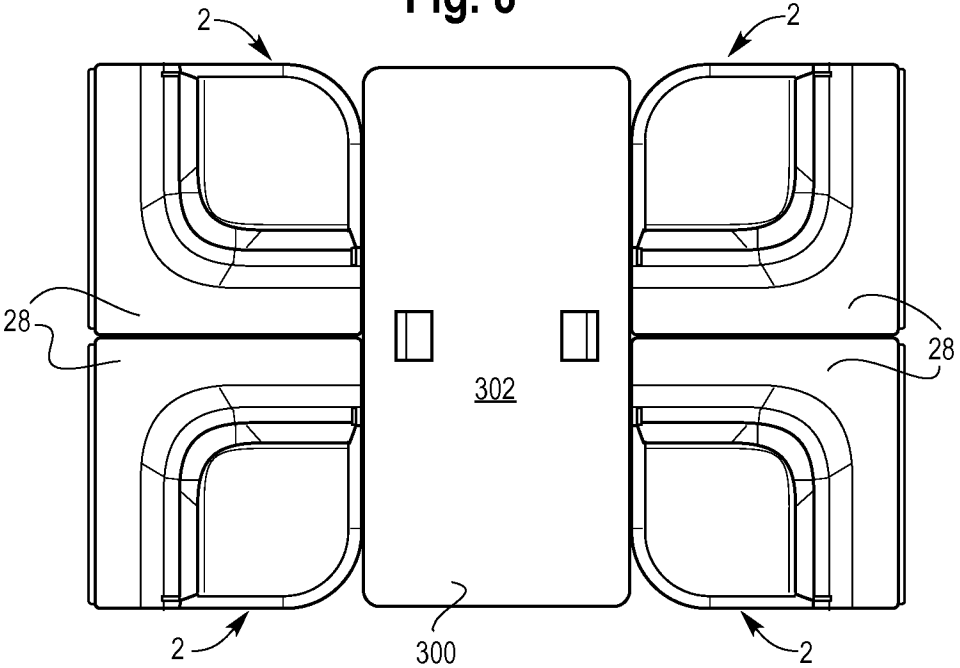
FIG. 8 is a plan view of the furniture configuration shown in FIG. 7.
Figure 9:
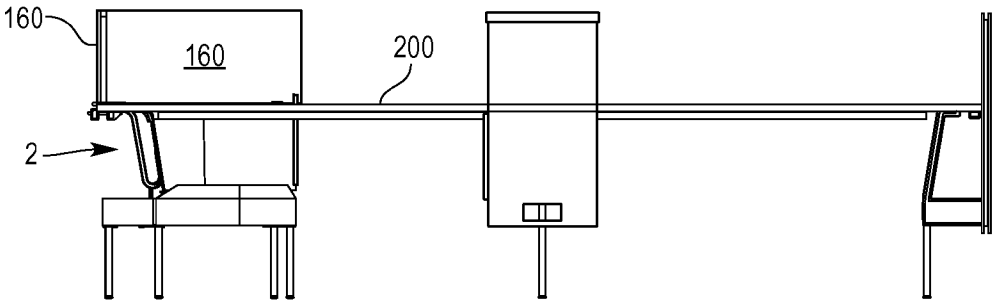
FIG. 9 is a front view of a furniture configuration including a chair and a pair of desks.
Figure 10:
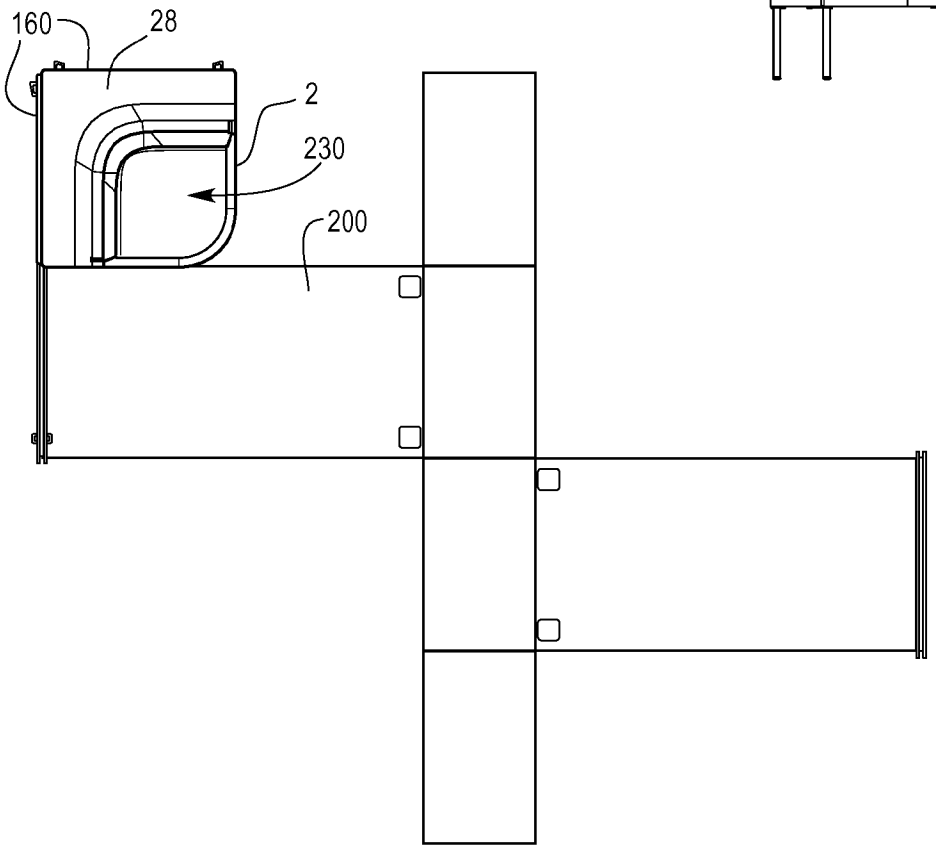
FIG. 10 is a plan view of the furniture configuration shown in FIG. 9.
Figure 12:
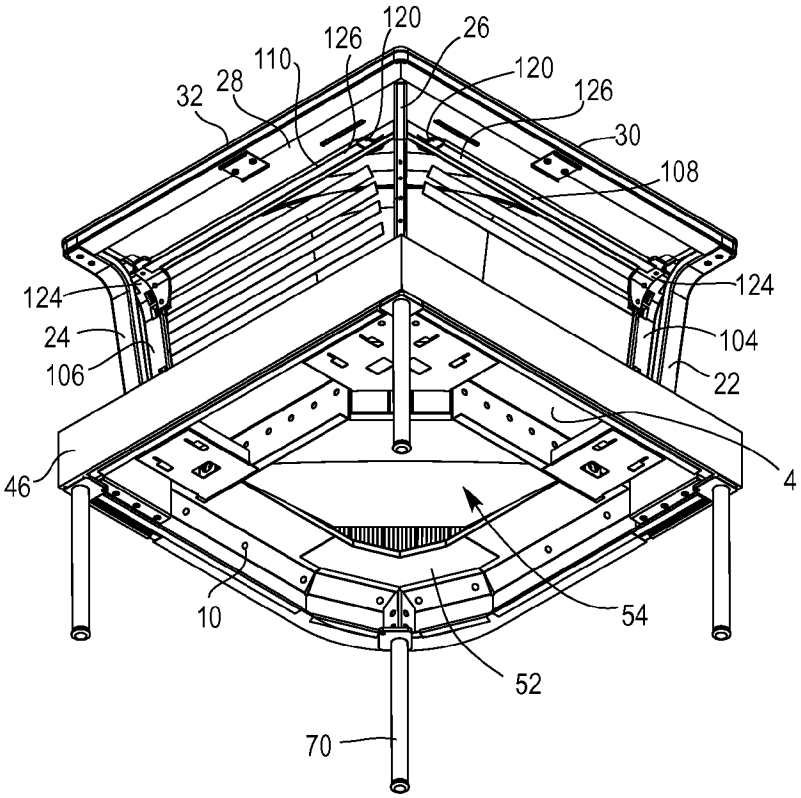
FIG. 12 is a rear perspective view of the chair shown in FIG. 11.
Figure 11:
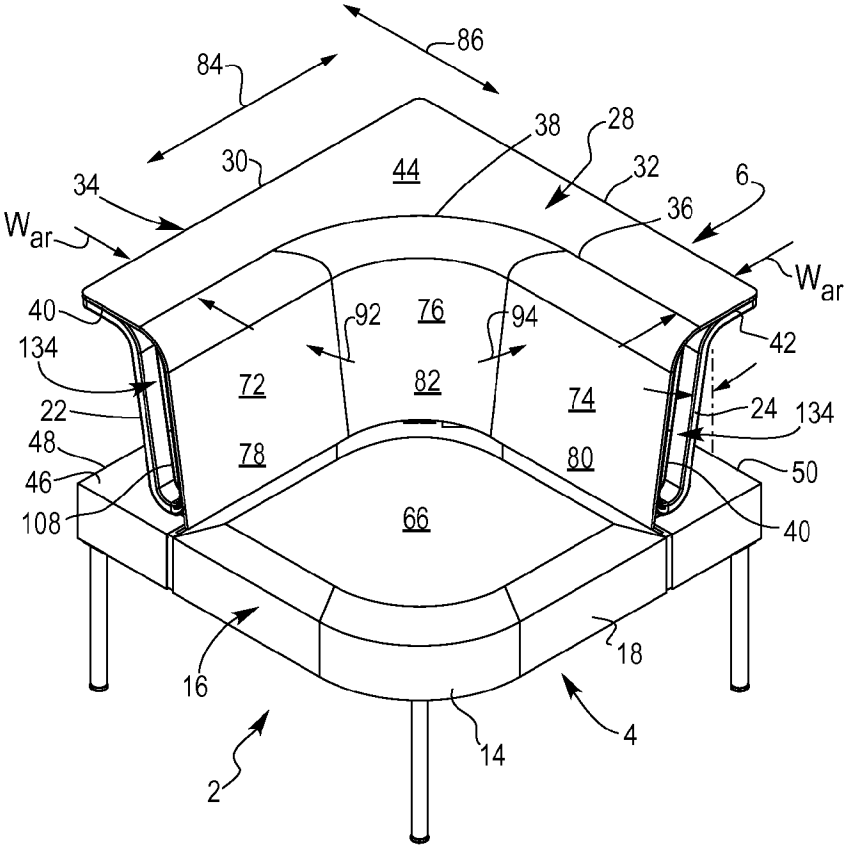
FIG. 11 is a front perspective view of one embodiment of a chair.
Figure 13:
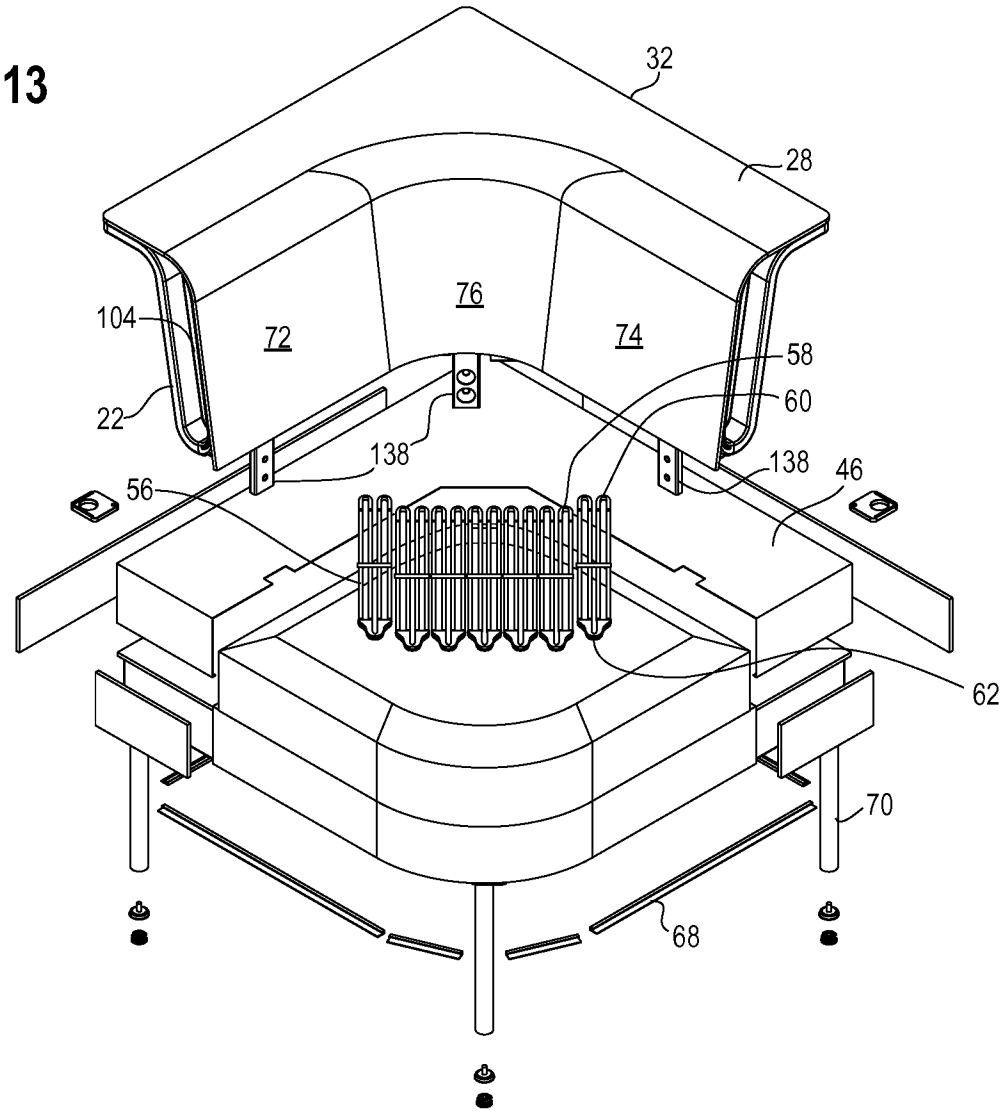
FIG. 13 is a exploded perspective view of the chair shown in FIG. 11.
Figure 14:
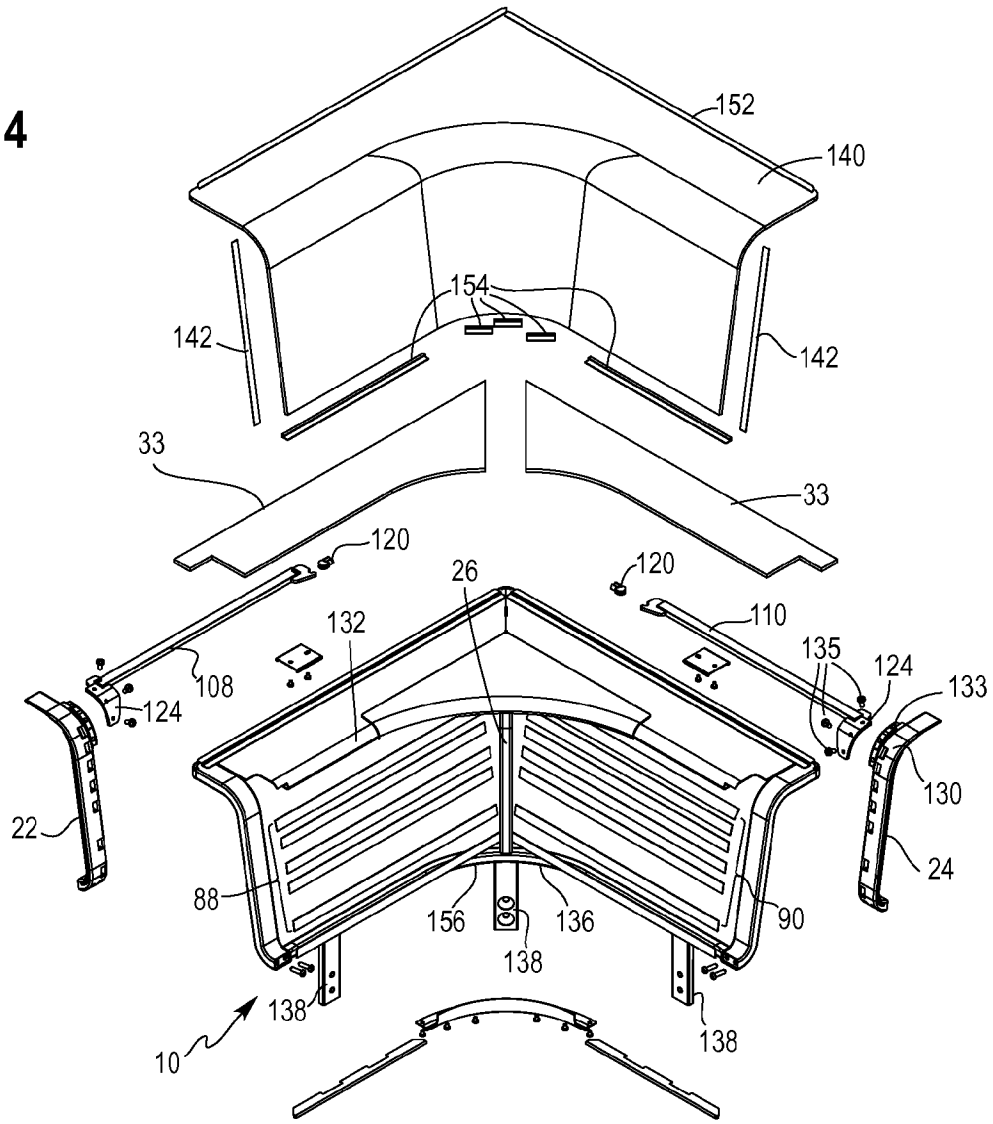
FIG. 14 is an exploded perspective view of the backrest of the chair shown in FIG. 11.

Referring to FIGS. 1 and 2, one or more tables 300 may be positioned adjacent one or more chairs 2, with the tables having an upper worksurface 302 lying substantially coplanar with the upper surface of the planar armrest platform 28 of one of the chairs 2 as further explained below. The tables 300 may be square or rectangular, as shown in FIGS. 1, 2 and 7, or have any other shape. The tables may have a shelf 310 underlying the worksurface that is co-planar with the shelf 46 of the chair.

Modular Furniture Arrangements

Referring to FIGS. 1, 2, 4 and 33, a modular furniture kit includes a plurality of chairs 2. In one configuration, a pair of chairs 2 is arranged with rear surfaces 30, 48, 32, 50 lying adjacent such that the planar armrest platform 28 define a T-shape in plan view. In another configuration, four chairs 2 are arranged with rear surfaces 30, 48, 32, 50 lying adjacent such that the planar armrest platforms 28 define a X-shape in plan view. In another configuration, a pair of chairs 2 having L-shaped armrests alone, or in combination with a third chair, or bench 400, having a back support portion with a linear rear edge 404 and upper surface 402 defining a planar armrest surface, are arranged with the rear surfaces being aligned such that the planar armrests define a U-shape in plan view.

In another embodiment, at least one table 300 having an upper worksurface 302 lying substantially coplanar with the upper surfaces of the planar armrest platforms 28 is positioned between pairs of chairs arranged in either the T-shaped configuration or the U-shaped configuration.

In another embodiment, a pair of chairs 2 are arranged with the rear surfaces 30, 48, 32, 50 lying adjacent such that the planar armrests define a Z-shape in plan view. In another embodiment, the tables 400 are positioned adjacent the rear surfaces 30, 48, 32, 50 of each of the first and second back supports such that one of the chairs and the pair of tables define a V-shape in plan view. In another embodiment, one table 400 is positioned adjacent a rear surface 30, 48 of a first back support, and another table 400 is positioned adjacent a side 16, 18 of a seat of the chair, wherein the chair and the pair of tables define a V-shape in plan view.

Figure 33:
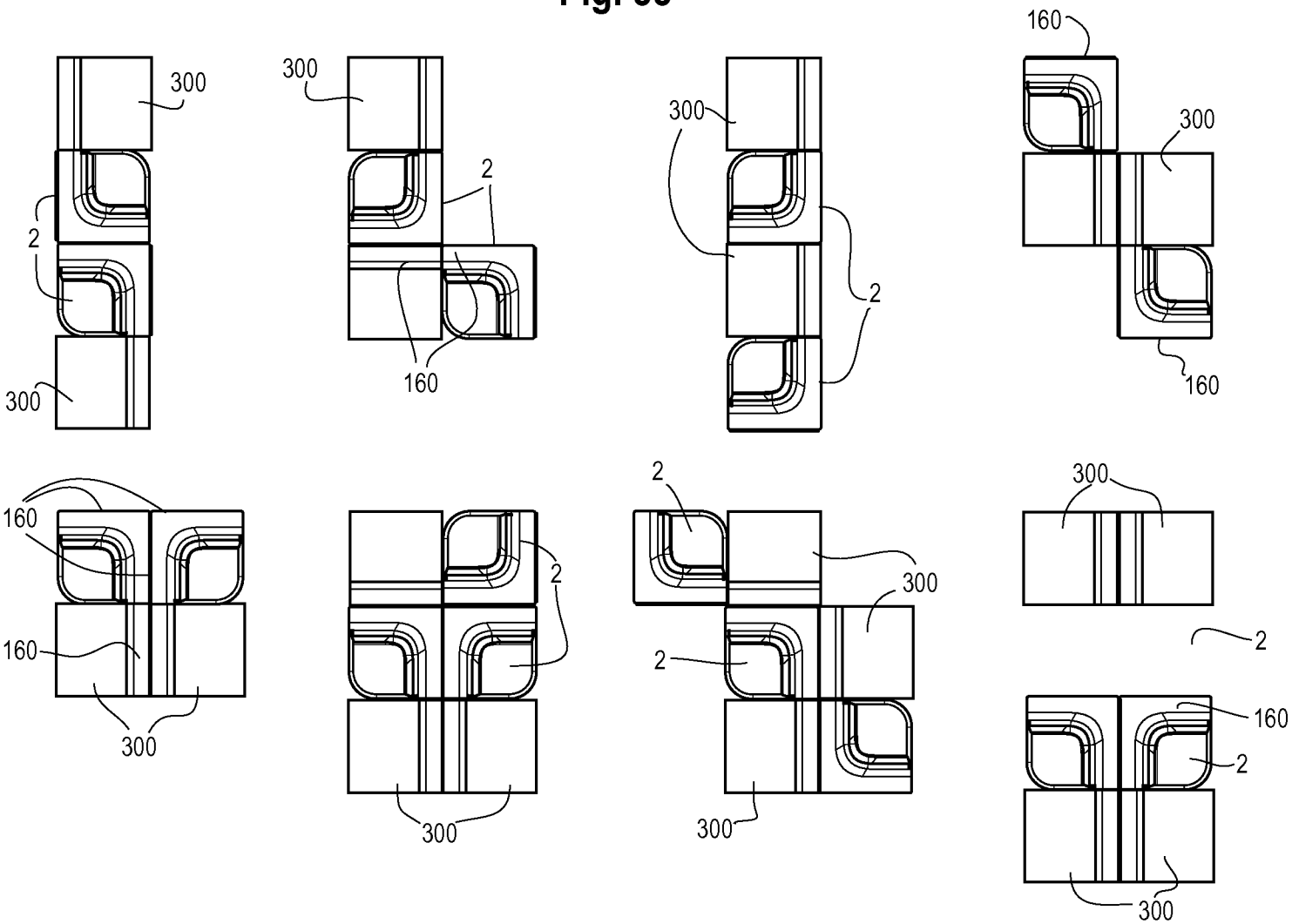
FIG. 33 is a plan view of a system showing different configurations of chairs and tables.

As shown in FIG. 33, other combinations of chairs 2 and tables 300 are shown. In addition, various screens 160 may be secured to the chairs in the different arrangements.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A suspension chair comprising:

a first back support portion having a first linear support surface extending along a first direction;

a second back support portion having a second linear support surface extending along a second direction, said second direction being substantially perpendicular to said first direction;

a third back support portion comprising an outwardly facing concave surface transitioning between said first and second back support portions;

first and second side support elements positioned adjacent to and connected to a side edge of respective ones of said first and second back support portions; and a rigid frame including a center support;

wherein said first and second back support portions comprise first and second suspension elements extending in said first and second directions respectively, wherein said first and second suspension elements are tensioned so as to provide first and second normal biasing forces to said first and second back support portions;

wherein said first and second suspension elements are tensioned in said first and second directions respectively;

wherein said first suspension element has a first end coupled to said first side support and a second end coupled to said center support; and wherein said second suspension element has a first end coupled to said second side support and a second end coupled to said center support.

2. The suspension chair of claim 1 wherein said first and second side support elements are pivotable about first and second axes extending in said first and second directions respectively.

3. The suspension chair of claim 2 further comprising a fixed support positioned adjacent an upper portion of said first and second side support elements, wherein said upper portions are moveable toward and away from said fixed support.

4. The suspension chair of claim 3 wherein said fixed support comprises a horizontal support surface defining an armrest, and wherein a front edge of said fixed support has first and second linear edge portions extending in said first and second directions and a curved edge portion joining said first and second linear edge portions.

5. The suspension chair of claim 4 wherein said first and second linear support surfaces and said concave support surface comprise a fabric layer covering and supported by said first and second suspension elements and covering said fixed support.

6. The suspension chair of claim 4 wherein said fabric layer is in direct contact with said first and second suspension elements.

7. The suspension chair of claim 4 further comprising a seat comprising a seat support portion and a shelf portion, wherein said shelf portion is vertically spaced from and underlies said armrest.

8. The suspension chair of claim 7 wherein a plan view footprint of said seat is substantially square.

9. The suspension chair of claim 8 wherein a corner of said seat support portion spaced diagonally outwardly from said third back support portion has a curved plan view shape.

10. The suspension chair of claim 8 wherein a corner of said seat support portion spaced diagonally outwardly from said third back support portion defines a right angle in plain view.

11. The suspension chair of claim 1 further comprising first and second brace members connected to and bracing said first and second side support elements in said first and second directions against tension forces applied by said first and second suspension elements.

12. The suspension chair of claim 1, wherein the first suspension element includes a first net that is stretched between the first side support and the center support, and wherein the second suspension element includes a second net that is stretched between the second side support and the center support.

13. A suspension chair comprising:

a base;

a fixed support supported by said base and defining an upper portion;

a rigid center support extending from the base to the fixed support;

first and second side supports supported by said base, said first and second side supports having a front surface and an upper portion; and a fabric layer covering at least a portion of said fixed support and a front surface of said first and second side supports; and first and second suspension elements supporting said fabric layer, wherein said first and second suspension elements are coupled to and tensioned between said first and second side supports and said rigid center support respectively.

14. The suspension chair of claim 13 wherein said upper portion of said fixed support defines an armrest.

15. The suspension chair of claim 13 wherein said first and second side supports comprise flexible members that are bendable about a horizontal axis.

16. The suspension chair of claim 13 wherein said upper portion of said fixed support has a front surface with a convex curvature.

17. The suspension chair of claim 13, wherein the first suspension element includes a first net that is stretched between the first side support and the rigid center support, and wherein the second suspension element includes a second net that is stretched between the second side support and the rigid center support.

18. The suspension chair of claim 13, further comprising a third suspension element coupled to the first suspension element and the second suspension element, wherein the third suspension element extends over the rigid center support.

19. The suspension chair of claim 13, wherein said first suspension element extends in a first direction, and wherein said second suspension element extends in a second direction that is substantially perpendicular to the first direction.

* * * * *